US012313389B1

(12) United States Patent
Krafcik et al.

(10) Patent No.: US 12,313,389 B1
(45) Date of Patent: May 27, 2025

(54) TUNABLE SAFE AND ARMING DEVICES AND METHODS OF MANUFACTURE

(71) Applicant: Northrop Grumman Systems Corporation, Falls Church, VA (US)

(72) Inventors: John S. Krafcik, Livermore, CA (US); Charles L. Weigel, Edina, MN (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 18/445,033

(22) Filed: Mar. 10, 2023

Related U.S. Application Data

(60) Provisional application No. 63/372,471, filed on Mar. 11, 2022.

(51) Int. Cl.
*F42C 15/184* (2006.01)
*F42C 15/24* (2006.01)

(52) U.S. Cl.
CPC ..... *F42C 15/184* (2013.01); *F42C 15/24* (2013.01)

(58) Field of Classification Search
CPC ..... F41C 15/24; F41C 15/26; F41C 15/005; F41C 15/184
See application file for complete search history.

(56) References Cited

U.S. PATENT DOCUMENTS 2,340,781 A 2/1944 Wagner
2,513,157 A 6/1950 Ferris et al.
2,687,482 A 8/1954 Harmon et al.
2,996,008 A 8/1961 Allen et al.
3,000,307 A 9/1961 Trotter, Jr.
3,111,080 A 11/1963 French et al.
3,111,088 A 11/1963 Fisk
3,233,950 A 2/1966 Baermann
(Continued)

FOREIGN PATENT DOCUMENTS

CA 2441277 10/2002
DE 3408585 9/1985
(Continued)

OTHER PUBLICATIONS

Baig et al., "Architecture for Range, Doppler and Direction Finding Radar", J. Appl. Environ. Biol. Sci., vol. 4, No. 7S, 2014, pp. 193-198.

(Continued)

*Primary Examiner* — Joshua E Freeman
(74) *Attorney, Agent, or Firm* — Christensen, Fonder, Dardi & Herbert PLLC

(57) ABSTRACT

A projectile with a safe and arming device includes a tunable setback arming mechanism with an arming slider constrained and guided within a slider frame. The arming slider and slider frame cooperating to have a first safe position, a second intermediate position, and a third armed position. Components, such as the arming slider are manufactured by electronic discharge machining (EDM) to provide preforms on a work piece that can be further processed and ultimately assembled into tunable setback arming mechanisms. Various desired operating characteristics of the setback arming mechanism may be provided by adjusting and/or selecting specific parameters in the arming slider and readily adjusting same through machining and heat treating.

11 Claims, 15 Drawing Sheets

(56) References Cited

U.S. PATENT DOCUMENTS 3,276,368 A * 10/1966 Tower ..... F42C 15/184 114/295
3,598,022 A 8/1971 Maier
3,614,181 A 10/1971 Meeks
3,747,529 A 7/1973 Plattner
3,809,995 A 5/1974 Hardin
3,913,870 A 10/1975 Bolick
3,939,773 A 2/1976 Jenkins et al.
3,943,520 A 3/1976 Apstein et al.
3,952,970 A 4/1976 Ozzechowski et al.
4,004,519 A 1/1977 Hopkins
4,044,682 A 8/1977 Karayannis
4,076,187 A 2/1978 Metz
4,088,076 A 5/1978 Karayannis
4,176,814 A 12/1979 Albrektsson et al.
4,177,733 A 12/1979 Romer et al.
4,202,515 A 5/1980 Maxwell, Jr.
4,207,841 A 6/1980 Bloomer
4,267,562 A 5/1981 Raimondi
4,284,862 A 8/1981 Overman et al.
4,347,996 A 9/1982 Grosso
4,373,688 A 2/1983 Topliffe
4,379,598 A 4/1983 Goldowsky
4,431,150 A 2/1984 Epperson, Jr.
4,438,893 A 3/1984 Sands et al.
4,475,996 A 10/1984 Inoue
4,512,537 A 4/1985 Sebestyen et al.
4,517,507 A 5/1985 Nordbrock et al.
4,520,972 A 6/1985 Diesinger et al.
4,525,514 A 6/1985 Yachigo et al.
4,528,911 A 7/1985 DePhillipo et al.
4,537,371 A 8/1985 Lawhorn et al.
4,547,837 A 10/1985 Bennett
4,565,340 A 1/1986 Bains
4,568,039 A 2/1986 Smith et al.
4,664,339 A 5/1987 Crossfield
4,665,332 A 5/1987 Meir
4,667,899 A 5/1987 Wedertz
4,686,442 A 8/1987 Radomski
4,715,284 A 12/1987 Hendry et al.
4,815,381 A 3/1989 Bullard
4,815,682 A 3/1989 Feldmann et al.
4,860,969 A 8/1989 Muller et al.
4,898,342 A 2/1990 Kranz et al.
4,899,956 A 2/1990 King et al.
4,901,621 A 2/1990 Tidman
4,934,273 A 6/1990 Endriz
4,964,593 A 10/1990 Kranz
5,043,615 A 8/1991 Oshima
5,072,647 A 12/1991 Goldstein et al.
5,097,165 A 3/1992 Mashino et al.
5,101,728 A 4/1992 Frisk
5,125,344 A 6/1992 Kline et al.
5,126,610 A 6/1992 Fremerey
5,139,216 A 8/1992 Larkin
5,271,328 A 12/1993 Boulais et al.
5,321,329 A 6/1994 Hovorka
5,322,002 A 6/1994 Miskelly, Jr. et al.
5,327,140 A 7/1994 Buckreub
5,379,968 A 1/1995 Grosso
5,381,445 A 1/1995 Hershey et al.
5,418,401 A 5/1995 Kaneyuki
5,425,514 A 6/1995 Grosso
5,452,864 A 9/1995 Alford et al.
5,489,909 A 2/1996 Dittmann et al.
5,495,221 A 2/1996 Post
5,506,459 A 4/1996 Ritts
5,529,262 A 6/1996 Horwath
5,619,083 A 4/1997 Dunfield et al.
5,669,581 A 9/1997 Ringer
5,696,347 A 12/1997 Sebeny, Jr. et al.
5,705,767 A * 1/1998 Robinson ..... F42C 19/06 102/221
5,725,179 A 3/1998 Gilman et al.
5,734,389 A 3/1998 Bruce et al.
5,747,907 A 5/1998 Miller
5,775,636 A 7/1998 Vig et al.
5,780,766 A 7/1998 Schröppel
5,788,178 A 8/1998 Barrett, Jr.
5,882,490 A 3/1999 Walder et al.
5,894,181 A 4/1999 Imlach
5,917,442 A 6/1999 Manoogian
5,932,836 A 8/1999 White
5,971,875 A 10/1999 Hill
5,982,319 A 11/1999 Borden et al.
5,986,373 A 11/1999 Stucker
6,020,854 A 2/2000 Jagnow et al.
6,052,647 A 4/2000 Parkinson et al.
6,126,109 A 10/2000 Barson et al.
6,135,387 A 10/2000 Seidel et al.
6,163,021 A 12/2000 Mickelson
6,167,809 B1 * 1/2001 Robinson ..... F42C 15/24 102/235
6,186,443 B1 2/2001 Shaffer
6,204,801 B1 3/2001 Sharka et al.
6,208,936 B1 3/2001 Minor et al.
6,227,820 B1 5/2001 Jarvik
6,234,082 B1 5/2001 Cros et al.
6,314,886 B1 11/2001 Kuhnle et al.
6,314,887 B1 * 11/2001 Robinson ..... F42C 19/06 102/262
6,321,654 B1 * 11/2001 Robinson ..... F42C 15/24 102/251
6,345,785 B1 2/2002 Harkins et al.
6,352,218 B1 3/2002 Holmqvist et al.
6,389,974 B1 5/2002 Foster
6,390,642 B1 5/2002 Simonton
6,398,155 B1 6/2002 Hepner et al.
6,422,507 B1 7/2002 Lipeles
D461,159 S 8/2002 Miralles et al.
6,443,391 B1 9/2002 Malejko et al.
6,493,651 B2 12/2002 Harkins et al.
6,502,786 B2 1/2003 Rupert et al.
6,505,561 B1 1/2003 Dietrich
6,568,329 B1 * 5/2003 Robinson ..... F42C 15/24 102/221
6,588,700 B2 7/2003 Moore et al.
6,595,041 B2 7/2003 Hansen
6,629,669 B2 10/2003 Jensen
6,653,972 B1 11/2003 Krikorian et al.
6,666,402 B2 12/2003 Rupert et al.
6,693,592 B2 2/2004 Dowdle et al.
6,705,231 B1 3/2004 Zacharin
6,727,843 B1 4/2004 Hansen
6,796,525 B2 9/2004 Johnsson et al.
6,806,605 B1 10/2004 Gabrys
6,834,591 B2 12/2004 Rawcliffe et al.
6,842,674 B2 1/2005 Solomon
6,869,044 B2 3/2005 Geswender
6,882,314 B2 4/2005 Zimmerman et al.
6,886,775 B2 5/2005 Johnsson et al.
6,889,934 B1 5/2005 Thomas et al.
6,923,404 B1 8/2005 Liu et al.
6,940,201 B2 9/2005 Umeda
6,964,231 B1 * 11/2005 Robinson ..... F42C 15/26 102/233
6,970,128 B1 11/2005 Dwelly et al.
6,981,672 B2 1/2006 Clancy et al.
7,015,855 B1 3/2006 Medl et al.
7,020,501 B1 3/2006 Elliott et al.
7,055,437 B1 * 6/2006 Robinson ..... F42C 15/184 102/222
7,069,861 B1 * 7/2006 Robinson ..... F41A 17/56 102/222
7,098,841 B2 8/2006 Hager et al.
7,174,835 B1 2/2007 Knapp
7,199,570 B2 4/2007 Ammar
7,226,016 B2 6/2007 Johnsson et al.
7,267,298 B2 9/2007 Leininger
7,296,520 B1 11/2007 McMullen, Jr.
7,305,467 B2 12/2007 Kaiser et al.
7,316,186 B1 * 1/2008 Robinson ..... F42C 15/24 102/251

(56) References Cited

U.S. PATENT DOCUMENTS 7,338,009 B1 3/2008 Bobinchak et al.
7,341,221 B1 3/2008 Wilson
7,354,017 B2 4/2008 Morris et al.
7,412,930 B2 8/2008 Smith et al.
7,422,175 B1 9/2008 Bobinchak et al.
7,431,237 B1 10/2008 Mock et al.
7,475,846 B2 1/2009 Schroeder
7,500,636 B2 3/2009 Bredy
7,548,202 B1 6/2009 Jennings
7,566,027 B1 7/2009 Johnson et al.
7,584,922 B2 9/2009 Bär et al.
7,626,544 B2 12/2009 Smith et al.
7,631,833 B1 12/2009 Ghaleb et al.
7,675,012 B1 3/2010 Bobinchak et al.
7,681,504 B2 3/2010 Machina et al.
7,701,380 B2 4/2010 Altes
7,781,709 B1 8/2010 Jones et al.
7,791,007 B2 9/2010 Harnoy
7,834,301 B2 11/2010 Clingman
7,849,798 B2 11/2010 Robinson et al.
7,849,797 B2 12/2010 Geswender et al.
7,849,800 B2 12/2010 Hinsdale et al.
7,900,619 B1 3/2011 Palmer et al.
7,913,623 B1 3/2011 Fan et al.
7,921,775 B1 4/2011 Althof et al.
7,947,936 B1 5/2011 Bobinchak et al.
7,950,149 B2 5/2011 Golecki
7,963,442 B2 6/2011 Jenkins et al.
7,989,742 B2 8/2011 Bredy
7,999,212 B1 8/2011 Thiesen et al.
8,063,347 B1 11/2011 Urbano et al.
8,076,623 B2 12/2011 Dryer
8,113,118 B2 2/2012 Schmidt et al.
8,125,198 B2 2/2012 Steinbrecher
8,183,746 B2 5/2012 Rastegar
8,229,163 B2 7/2012 Coleman et al.
8,258,999 B2 9/2012 Rastegar et al.
8,276,515 B1 * 10/2012 Robinson ..... F42C 15/34 102/231
8,288,698 B2 10/2012 Seidensticker
8,288,699 B2 10/2012 Romero et al.
8,319,162 B2 11/2012 Mccool
8,319,163 B2 11/2012 Flood et al.
8,319,164 B2 11/2012 Martinez
8,324,542 B2 12/2012 Frey, Jr.
8,344,303 B2 1/2013 Elgersma et al.
8,410,412 B2 4/2013 Geswender et al.
8,426,788 B2 4/2013 Geswender
8,448,574 B1 5/2013 Robinson et al.
8,471,186 B2 6/2013 Wallis
8,471,758 B2 6/2013 Samuel et al.
8,485,722 B1 7/2013 Roeder et al.
8,487,226 B2 7/2013 Biswell
8,508,404 B1 8/2013 Wilmhoff
8,519,313 B2 8/2013 Geswender et al.
8,522,682 B1 * 9/2013 Genson ..... F42C 11/02 102/275.9
8,552,349 B1 10/2013 Alexander
8,552,351 B2 10/2013 Geswender et al.
8,558,151 B2 10/2013 Seidensticker
8,624,171 B2 1/2014 Frey, Jr.
8,640,620 B1 * 2/2014 Hoang ..... F42C 15/184 102/229
8,669,505 B2 3/2014 Guibout et al.
8,674,277 B2 3/2014 Axford et al.
8,698,059 B2 4/2014 Nikkel et al.
8,701,558 B2 4/2014 Rastegar et al.
8,716,639 B2 5/2014 Mallon
8,748,787 B2 6/2014 Weiss et al.
8,757,064 B2 6/2014 Jennings et al.
8,812,654 B2 8/2014 Gelvin et al.
8,816,260 B2 8/2014 Hindman et al.
8,832,244 B2 9/2014 Gelvin et al.
8,836,503 B2 9/2014 Gelvin et al.
8,887,640 B1 11/2014 Knight et al.
8,916,810 B2 12/2014 Geswender et al.
8,950,335 B2 2/2015 Strömberg et al.
8,993,948 B2 3/2015 Geswender et al.
D729,896 S 5/2015 Martinez
9,031,725 B1 5/2015 DiEsposti
9,040,885 B2 5/2015 Morris et al.
9,048,701 B2 6/2015 Lang
9,052,202 B2 6/2015 Riley
9,070,236 B1 6/2015 DiEsposti
9,071,171 B2 6/2015 Rastegar et al.
9,086,258 B1 7/2015 Vasudevan et al.
9,089,916 B2 7/2015 Itokazu et al.
9,108,713 B2 8/2015 Tao et al.
9,187,184 B2 11/2015 Miralles et al.
9,194,675 B1 11/2015 Manole et al.
9,211,947 B2 12/2015 Miralles
9,303,964 B2 4/2016 Wurzel et al.
9,347,753 B1 5/2016 Horch et al.
9,360,286 B2 6/2016 Pettersson et al.
9,371,856 B2 6/2016 Kundel
9,410,783 B1 8/2016 Khuc et al.
9,557,405 B2 1/2017 Takahashi et al.
9,587,923 B2 3/2017 Wurzel et al.
9,644,929 B1 5/2017 Bradbury et al.
9,683,814 B2 6/2017 Dryer
9,709,372 B2 7/2017 Edwards
9,939,238 B1 4/2018 Sowle et al.
10,008,239 B2 6/2018 Eris
10,038,349 B2 7/2018 Long et al.
10,054,404 B2 8/2018 Balk et al.
10,086,457 B2 10/2018 Kurihara
10,203,188 B1 2/2019 Sowle et al.
10,288,397 B2 5/2019 Rastegar et al.
10,300,542 B2 5/2019 Miyake et al.
10,471,528 B2 11/2019 Tomioka
11,031,885 B1 6/2021 Yavid
11,056,962 B2 7/2021 Kao
11,300,389 B1 4/2022 Han
11,313,655 B1 4/2022 Han
2001/0030260 A1 10/2001 Niemeyer et al.
2003/0070571 A1 4/2003 Hodge et al.
2003/0076260 A1 4/2003 Ryken et al.
2004/0046467 A1 3/2004 Huang et al.
2004/0068415 A1 4/2004 Solomon
2004/0099173 A1 5/2004 Rector et al.
2004/0134337 A1 7/2004 Solomon
2005/0034627 A1 2/2005 Manole et al.
2005/0061191 A1 3/2005 Dietrich et al.
2006/0061949 A1 3/2006 Chen et al.
2008/0012751 A1 1/2008 Owens et al.
2008/0061188 A1 3/2008 Morris et al.
2008/0093498 A1 4/2008 Leal et al.
2008/0115686 A1 5/2008 Crist et al.
2008/0223977 A1 9/2008 Dryer
2008/0237391 A1 10/2008 Mock et al.
2008/0257867 A1 10/2008 Malshe et al.
2010/0140226 A1 6/2010 Sheu
2010/0199873 A1 8/2010 Rastegar
2010/0213307 A1 8/2010 Hinsdale et al.
2010/0237185 A1 9/2010 Dryer
2010/0285721 A1 11/2010 Ma
2011/0032361 A1 2/2011 Tamir
2011/0094372 A1 4/2011 Carlson
2011/0114602 A1 5/2011 Bush et al.
2012/0068000 A1 3/2012 Goldner et al.
2012/0211593 A1 8/2012 Morris et al.
2012/0255426 A1 10/2012 Reynard et al.
2013/0126612 A1 5/2013 Durkee
2013/0126667 A1 5/2013 Weiss et al.
2013/0126668 A1 5/2013 Chessel et al.
2013/0228553 A1 9/2013 Okamoto et al.
2013/0240486 A1 9/2013 Yamada et al.
2014/0291441 A1 10/2014 Bellotte et al.
2015/0144599 A1 5/2015 Kouda
2015/0203201 A1 7/2015 Tao et al.
2015/0247714 A1 9/2015 Teetzel et al.
2015/0330755 A1 11/2015 Citro et al.
2015/0338280 A1 * 11/2015 Houde-Walter ..... G01S 7/495 250/341.1

(56) References Cited

U.S. PATENT DOCUMENTS

| | | | | |
|---|---|---|---|---|
| 2016/0003597 | A1* | 1/2016 | Burrow | C22C 38/44 86/18 |
| 2016/0185445 | A1 | 6/2016 | Miralles et al. | |
| 2016/0252333 | A1 | 9/2016 | Carlqvist et al. | |
| 2016/0347476 | A1 | 12/2016 | Andryukov | |
| 2016/0349026 | A1 | 12/2016 | Fairfax et al. | |
| 2017/0021945 | A1 | 1/2017 | Fisher et al. | |
| 2017/0023057 | A1 | 1/2017 | Li et al. | |
| 2017/0115103 | A1 | 4/2017 | Chargelegue et al. | |
| 2017/0191809 | A1 | 7/2017 | Harris et al. | |
| 2017/0266744 | A1 | 9/2017 | Sekimoto et al. | |
| 2017/0299355 | A1 | 10/2017 | Trouillot et al. | |
| 2017/0336184 | A1 | 11/2017 | Merems | |
| 2018/0245895 | A1 | 8/2018 | Malul et al. | |
| 2019/0041175 | A1 | 2/2019 | Fellows et al. | |
| 2019/0041527 | A1 | 2/2019 | Gutafson | |
| 2019/0107374 | A1 | 4/2019 | Hill | |
| 2019/0302276 | A1 | 10/2019 | Sandford | |
| 2019/0316887 | A1 | 10/2019 | Buttolph | |
| 2020/0064112 | A1 | 2/2020 | Raml | |
| 2020/0240757 | A1 | 7/2020 | Pinoteau | |
| 2020/0292287 | A1 | 9/2020 | Thoren et al. | |
| 2021/0381813 | A1* | 12/2021 | Burrow | F42B 5/16 |
| 2022/0349688 | A1* | 11/2022 | Barbulescu | F42B 10/28 |

FOREIGN PATENT DOCUMENTS

| | | |
|---|---|---|
| DE | 10015514 | 10/2001 |
| EP | 0675335 | 10/1995 |
| EP | 1154223 | 7/2005 |
| EP | 2165152 | 8/2014 |
| EP | 3392603 | 10/2018 |
| EP | 3553458 | 10/2019 |
| EP | 3671102 | 6/2020 |
| GB | 2547425 | 8/2017 |
| WO | WO2007058573 | 5/2007 |
| WO | WO2011114089 | 9/2011 |
| WO | WO2013006106 | 1/2013 |
| WO | WO2014102765 | 7/2014 |

OTHER PUBLICATIONS

Bekmezci et al., "Flying Ad-Hoc Networks (FANETs): A Survey", posted on the Internet at elsevier.com/locate.adhoc; Jan. 8, 2013, published by Elsevier, Amsterdam, The Netherlands; 17 pages.

Costanzo et al., "High Resolution Software Defined Radar System for Target Detection", Journal of Electrical and Computer Engineering, vol. 2013, Article ID 573217, 2013, 8 pages.

Kwag et al., "Modern Software Defined Radar (SDR) Technology and Its Trends", Journal of Electromagnetic Engineering and Science, vol. 14, No. 4, Dec. 2014, pp. 321-328.

Zhang, B. et al. Mechanical Construction and Analysis of an Axial Flux Segmented Armature Torus Machine, International Conference on Electrical Machines, Sep. 2-5, 2014, pp. 1293-1299.

Zou, T. et al., "Analysis of a Dual-Rotor, Toroidal-Winding, Axial-Flux Vernier Permanent Magnet Machine", Institute of Electrical and Electronics Engineers, May/Jun. 2017, vol. 53, No. 3, pp. 1920-1930.

* cited by examiner

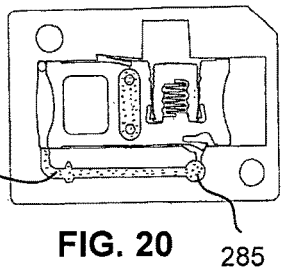
FIG. 20
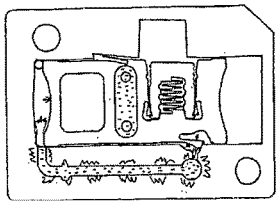
FIG. 21
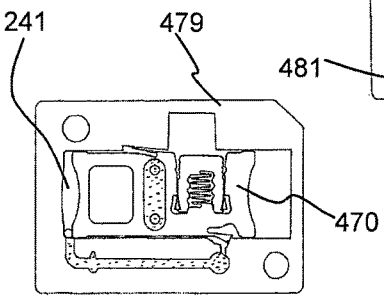
FIG. 19
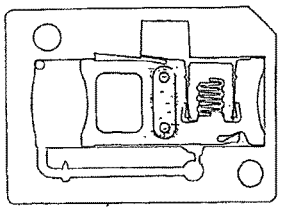
FIG. 22A
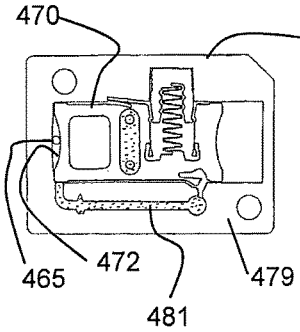
FIG. 18
FIG. 22B
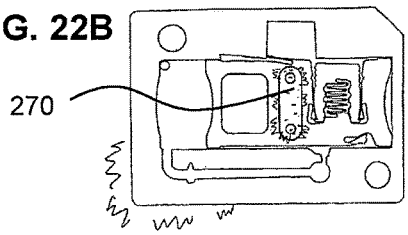
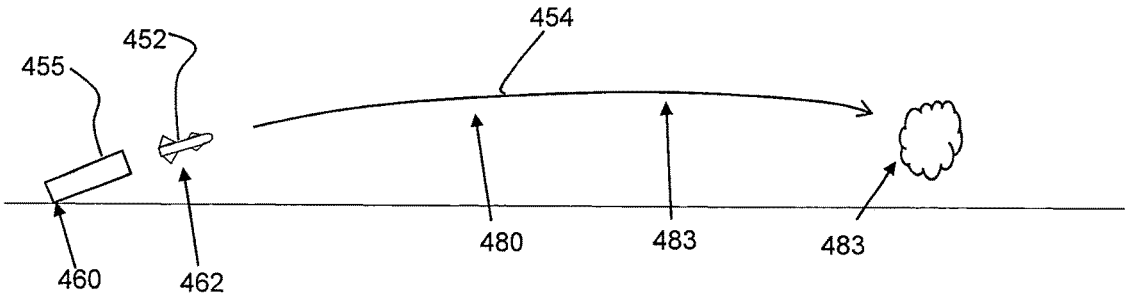
FIG. 17

| |
|---|
| Select metal for work piece for multiple slider preforms |
| Cut or provide work piece sized for EDM |
| Heat treat work piece |
| Machine holes for in work piece for wire EDM |
| Machine plurality of preforms with micro wire EDM Leaving tabs for securing preform in work piece |
| Machine recess for transfer charge in each preform |
| Deposit charge in transfer charge recess in each preform with automated printer/syringe |
| Cut tabs of each preform forming arming sliders |
| Remove arming sliders with pick and place equipment |
| Assemble preforms into MEMSADs |

FIG. 40

FIG. 41

| |
|---|
| Identify launch, flight, and targeting characteristics of projectile |
| Select desired performance characteristics of TSAM in MEMSAD |
| Select TSAM structure variables to adjust |
| Adjust/select structure of structure variables to obtain desired performance characteristics |
| Select desired material characteristics |
| Select material for desired material characteristics |

FIG. 42

| |
|---|
| Arming slider mass – adjust/select by window size |
| Arming slider mass – adjust/select by arming slider thickness |
| Setback slider mass – adjust/select by setback slider size (area) |
| Setback slider spring force – adjust/select by spring strand thickness |
| Setback slider spring force – adjust/select by spring strand length |
| Setback slider spring force – adjust/select by lobe configuration |
| Arming slider metal characteristics – adjust/select by metal selection |
| Arming slider metal characteristics – adjust/select by heat treating |
| Command latch performance – adjust/select by size/shape |

TUNABLE SAFE AND ARMING DEVICES AND METHODS OF MANUFACTURE

CROSS-REFERENCE TO RELATED APPLICATIONS

This application claims the benefit of U.S. Provisional Patent Application No. 63/372,471, filed Mar. 11, 2022, which is hereby fully incorporated herein by reference.

FIELD OF THE DISCLOSURE

The present disclosure relates to munitions with safety and arming devices for munitions, and more specifically to micro setback arming mechanisms and methods of manufacturing such.

BACKGROUND

Extensive efforts have been directed toward incorporating modern miniaturization technologies in the functionalities of munitions. This includes processing, communications, sensing, guidance, control, and fusing systems. Such allows providing enhanced performance munitions, including in the 30 mm range that are "smart", capable of guiding, steering, seeking, sensing, and timing of detonations. Such projectiles greatly enhance target engagement and operational efficiencies compared to traditional projectiles. In addition, capabilities can reduce collateral damage, conserve ammunition, reduces costs, minimize personnel time in engaging targets, provide enhanced safety to warfighters using the munitions, among other benefits.

Such projectiles have included barrel-fired and non-barrel-fired projectiles, boosted, and non-boosted projectiles, and spin-stabilized and fin-stabilized projectiles. In addition, such projectiles have included, low-caliber (50 caliber or less), medium-caliber (greater than 50 caliber to 75 mm), and large caliber projectiles (greater than 75 mm and generally used as artillery, rockets, and missiles).

It is generally understood in the art that fuzing, sensing, communications, proximity, and other functions are generally required for such projectiles. For example, GPS, height-of-burst (HOB), sensing, seeking, proximity detection, and other functions add capabilities for control or to enhance projectile performance to engage a target. Further improvements are always welcome for these projectiles that enhance safety, improve accuracy, allow, increase range, provide cost savings, or improve reliability. Additionally, miniaturization of the fusing components provides additional space for other componentry or additional munition payload.

With respect to fuzing, safety and arming devices (SADs) are required in essentially all barrel fired munitions such as mortar shells, artillery shells, grenades, medium caliber ammunition. The safety and arming, (S&A), provide for arming only in a specific environment, such as after a munition has been launched, the arming effected by the acceleration or spinning imparted to the projectile. Conventionally, such S&A fuzes were manufactured with complicated three dimensioned machined parts. See, for example U.S. Pat. Nos. 6,705,231; 4,284,862; and 4,815,381, all of which are incorporated by reference herein for all purposes.

Efforts have been made to incorporate MEMS (microelectromechanical systems) technologies into S&A mechanisms (SAMs) for fuzing systems with the goals of greatly reduced the size and cost of S&A fuzes while still providing reliable fuzes with long shelf lives. Such efforts have included, for example, using photolithography generally associated with semiconductor wafer manufacturing technologies. This includes X-ray LIGA (Lithographie, Galvanoformung, Abformung, for lithograph, electroplating, and molding), UV LIGA, and Microfabrica layered lithography. See for example, U.S. Pat. Nos. 6,314,887; 6,568,329; 6,964,231; 7,055,437; 7,849,798; 7,913,623; 8,640,620; and 8,448,574, all of which are incorporated by reference herein for all purposes. The efforts have included micro switches with sliders that close an electrical switch due to forces associated with firing the munition, and sliders that block and then align components of a microscale firetrain for arming and detonating the warhead through the completed microscale firetrain. These efforts have resulted in novel configurations of fuze designs of extremely small volumetric size, including a 4-layered stacked assembly having a cover layer, an initiator board layer, a MEMS setback arming mechanism (SAM) layer having arming slider in a frame, and an output explosive layer for detonating the projectile warhead. Such a MEMS based fuze configuration is disclosed in U.S. Pat. No. 8,448,574. Such arming sliders have a setback slider released upon firing that thereby releases a main arming slider that is stopped from going to an armed position by a further latch, the further latch is subsequently released by a charge initiated by the fusing system. It is not believed that these efforts in utilizing conventional MEMS manufacturing techniques have yet resulted in a meaningful implementation of MEMS based safe and arming mechanisms in fusing systems for munitions on a production level.

SUMMARY OF THE INVENTION

The inventors have novel techniques and manufacturing methods to provide micro safety and arming devices with setback arming mechanisms, SAM configurations allowing high volume production levels, reliability levels, tunability of designs, and cost savings that make micro tunable safe arming mechanisms (TSAMs) practical for incorporation in an array of mass produced munitions.

Conventional MEMS manufacturing technologies, such as photolithography fabrication, machine lapping and chemical processing found in X-ray LIGA, UV LIGA and Microfabrica layered lithography, have been found to be very expensive and labor intensive in the context of manufacturing setback arming mechanisms. The inventors have identified that precisely controlled toleranced thicknesses, recesses, with a very required high repeatability in the context of a layered fuze assembly with MEMS using conventional semiconductor lithography techniques is extremely challenging. The inventors have observed that obtaining the required combination of freedom of motion of moving parts, sealing and barrier integrity for the energetics, reliability of functionality of the mechanisms, high levels of production, along with cost control using conventional MEMS lithography has been problematic.

Moreover, specific material types available for use in conventional MEMS manufacturing do not have truly homogenous and consistent material and mechanical properties resulting in functional limitations. Additionally, preprocessing and post processing the material is difficult or impossible. Moreover, such conventional MEMS manufacturing techniques can only provide a limited range of material thickness for the componentry, and these thicknesses are not precisely toleranced. These legacy techniques are not highly repeatable and supports only a limited range of materials and properties for designing springs, latches, hurdles for controlling the movement of the TSAM. In addition, the fabricators and designers for using traditional MEMS manufacturing are extremely limited in numbers, with small-scale operations and limited on skilled processing technicians/technologists.

The inventors have identified manufacturing process where particular parameters of the arming slider and setback slider that may be easily adjusted to adapt the setback arming mechanism to a vast array of barrel fired munitions with varying launch velocities and varying spin rates without affecting the slide frame arming slider interaction. The same fuzing module with the same components may be used replacing only minimal components, for example, only the slider. Contrary to expectations, it has been found that utilization of electronic discharge machining can provide a highly precise low toleranced arming slider and setback slider for a setback arming mechanism in essentially the same scale as provided in conventional MEMS manufacturing utilizing lithography.

In embodiments, a method of manufacturing fuzing modules for an array of barrel fired munitions with varying launch velocities and varying spin rates comprises utilizing a common components in a fuzing module with exactly the same overall size, measurements and profile which changing out only the arming slider. In embodiments, even non spinning projectiles can utilize the fuzing module with the exactly the same overall size, measurements and profile which changing out only the arming slider. The variations in the arming slider varying a spring constant rate of the set back slider, varying the mass of the setback slider, varying the mass of the main body of the arming slider, varying the size of the energetic slot in the arming slider. In other embodiments, the depth of recess of the frame receiving the arming slider and the thickness of the arming slider may be changed. In embodiments, varying the metal characteristics, such as ductility, tensile strength, spring constants, can be provide to the overall arming slider or to discrete portions of same.

A feature and advantage of embodiments is providing a precision safe and arming mechanism of high reliability and low cost that eliminates the need for expensive and labor intensive technologies, such as photolithography fabrication, machine lapping and chemical processing found in X-ray LIGA, UV LIGA and Microfabrica layered lithography.

A feature and advantage of embodiments is that an array of materials are available for the principal components, said materials are readily available in precise controlled thicknesses suitable for use in the layered safe and arming mechanism assemblies, in particular for example, the arming slider. In embodiments, stainless steel sheet material may be provided and the arming slider may be cut out of the material in the precise desired shape by electronic discharge machining, either wire EDM or plunge EDM. Subsequent to machining, the slider, or portions thereof, may be heat treated, to adjust specific parameters of the arming slide. For example, the arming slider can be annealed to adjust tensile strength of the stainless steel. The tensile strength affects the spring constant of the spring displacing the setback slide. Additionally, heat treating the post cut arming slide affects the deformability of stainless steel, which can allow easier latching by latch members. Such options of adjusting these parameters after machining the final or near final shape of the arming slider are generally not available with materials utilized for manufacturing by lithography related methods. Moreover, discrete portions of arming sliders may be heat treated such as by heating with a laser.

A feature and advantage to embodiments is that a simplified design over known layered MEMS setback arming mechanisms is provided, minimizing the most delicate portions of known design and facilitating easier, less complicated machining. The design may be modified without changing its footprint for providing different mass of the arming slider, different masses of the setback slider, different spring constants for the setback slider spring, different deformation properties of the arming slider components, for example. Such common footprint allows use of the same frame for constraining and guiding the arming slider and simplifies machining operations for multiple different arming sliders.

In embodiments, a safe arming mechanism includes a setback arming mechanism comprising a flat and planar arming slider that has a setback latch that is actuated upon firing the projectile.

A feature and advantage of embodiments is a setback arming mechanism that does not have intricate and difficult to machine arrow shaped latches for retaining the sliders in the armed position.

Various embodiments of the disclosure provide benefits from a low-cost and mechanically simple design for a projectile safe and arming fuze mechanism.

In embodiments, a MEMS safe and arming mechanism is available for a variety of platforms utilizing a single set of uniform components and changing out only one component, the arming slider. The MEMS safe and arming mechanism has the identical exterior package. In embodiments, the arming slider has the same exterior perimeter configuration minimizing inventories of other components.

Embodiments of the disclosure provide a micro setback arming mechanism that can be utilized in large caliber, medium caliber, and small caliber projectiles, spin stabilized and non-spinning or low spinning projectiles.

Although EDM machining has conventionally been considered to be a very slow machining process, embodiments herein, for example, utilizing automation, utilizing multiple EDM machines operating simultaneously, utilizing multiple wires to simultaneously cut multiple preforms on a single or stacked work pieces, in association with the overall short lengths of the cuts, overcomes these perceived EDM disadvantages. EDM machining a multiplicity of preforms and then removing the preforms as arming sliders as disclosed herein is an exceptionally expedient process.

A feature and advantage of embodiments is that a multiplicity of arming sliders may be manufactured with incremental different structure (size, shape, thickness) determined by the machining and incrementally different material properties of the arming sliders such that a plurality of arming sliders may be tested together in a single projectile firing to assess the functionality and effectiveness of the different structures and different material properties.

In embodiments, a feature and advantage is that machining may be performed on work pieces by milling machines to provide features for the preforms before the EDM machining of the slider preforms or other TSAM components.

A feature and advantage of embodiments is that machining operations are readily performable on preforms retained in a work piece by micro tabs that is not available in conventional MEMS manufacturing methods.

Additionally, one or more embodiments are directed to computer readable storage medium including an encoded design structure representation of one or more embodiments of the disclosure.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 17 is a pictorial view illustrating an exemplary firing path of a non-spinning projectile in accord with embodiments.

FIG. 18 is a plan view of a setback and arming mechanism in a pre-firing safe mode in accord with embodiments.

FIG. 19 is a plan view of the setback and arming mechanism of FIG. 18 after firing in a setback mode with the setback slider retracted into the setback slider slot and the arming slider advanced by force from the cam ball, the arming slider stopped by a command latch.

FIG. 20 is a plan view of the setback and arming mechanism of FIGS. 18-19 with the camming ball set forward as the projectile encounters air resistance, for example.

FIG. 21 is a plan view of the setback and arming mechanism of FIGS. 18-20 with the command charge initiated for releasing the command latch and for urging the arming slider forward to the fully armed position.

FIG. 22A is a plan view of the setback and arming mechanism of FIGS. 18-21 with arming slider slid forward after release of the command latch and in an armed position.

FIG. 22B is a plan view of the setback and arming mechanism of FIGS. 18-22 in an armed position.
and with the detonation micro fire train initiated.

FIG. 40 is a table of steps for manufacturing TSAM components according to embodiments.

FIG. 41 is a table of steps in designing a TSAM according to embodiments.

FIG. 42 is a table of TSAM component variables for tuning TSAMS.

Figure 3:
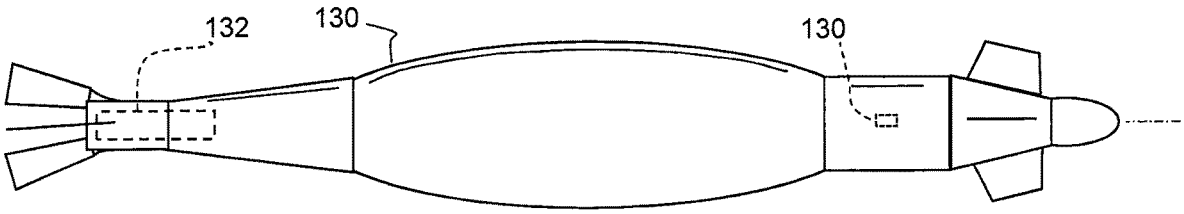
FIG. 3 depicts a side view of another projectile with a fuzing system including a setback arming mechanism in accord with embodiments.

While the embodiments of the disclosure are amenable to various modifications and alternative forms, specifies thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1:
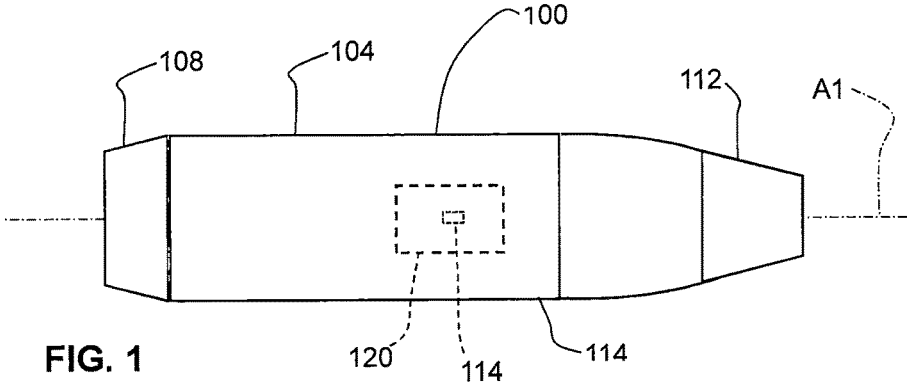
FIG. 1 depicts a side view of a projectile with a fuzing system including a setback arming mechanism in accord with embodiments of the disclosure.
Figure 2:
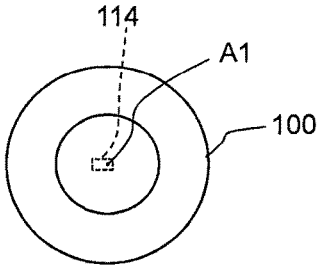
FIG. 2 depicts a side view of the projectile of FIG. 1 according to one or more embodiments of the disclosure.

Referring to FIGS. 1-3, two different munitions are illustrated. FIGS. 1 and 2 are a side view and end view of an artillery projectile 100 that is fired from a rifled barrel. In various embodiments, the projectile 100, includes a main body portion 104, a tail portion 108, and a nose portion 112. A projectile sidewall or projectile chassis 114 defines at least the main body portion 104 and can additionally define the tail portion 108 and/or nose portion 112. The projectile has an axis A1 about which it spins and may have guidance and flight control capabilities. The projectile has a fuzing system 120 including a safety and arming device 125 including a tunable setback arming mechanism of "TSAM" illustrated in detail below. FIG. 3 illustrates a finned projectile 130 that has minimal or no spin when fired and may have a rocket motor 132 for propulsion and also has a safety and arming device 135 with the tunable setback and arming mechanism as described below.

Figure 4:
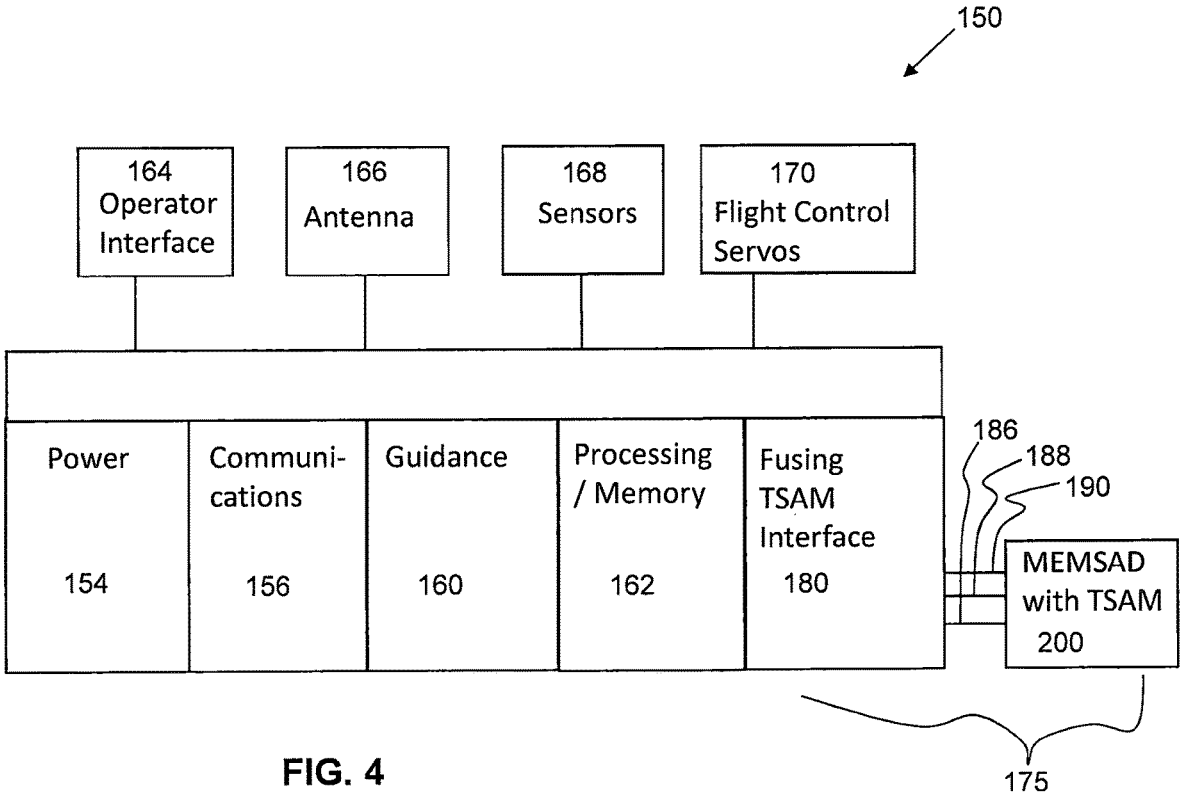
FIG. 4 depicts a block diagram of the electronic operational systems of a projectile with a setback arming mechanism in accord with embodiments.

Referring to FIG. 4, each of the projectiles 100, 130 have projectile circuitry 150 that is illustrated by the block diagram with functional portions or units illustrated. The functional units may be combined and may or may not be physically separated or be discrete units. As used herein, the term projectile circuitry assembly refers to a collection of one or more projectile components, modules, wiring, and the like, that are configured to perform one or more various projectile functions. Projectile circuitry and the functional units include mechanical and electro-mechanical components and modules with same being positioned throughout such projectiles. The functional units may include, but are not limited to, power 154, communications 156, guidance 160, processing/memory 162, operator interface 164, antenna 166, sensors 168, flight control mechanisms 170, and fuzing 175. In embodiments the projectile circuitry 150 includes a fusing interface 180 with three output conductors 186, 188, 190 that connect to a micro electro-mechanical safety and arming device 200 or "MEMSAD". The three output conductors may be a command lock release conductor 186, a detonation conductor 188, and a common conductor 190. The MEMSAD includes a tunable setback arming mechanism as described below.

Figure 5A:
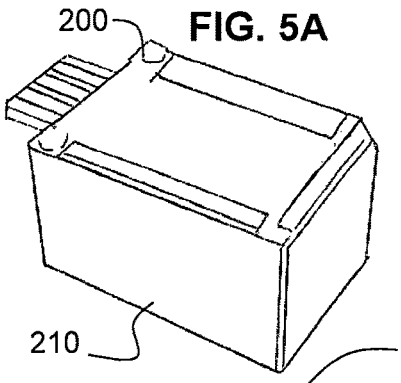
FIG. 5A depicts a perspective view of a safety and arming device according to one or more embodiments of the disclosure.
Figure 5B:
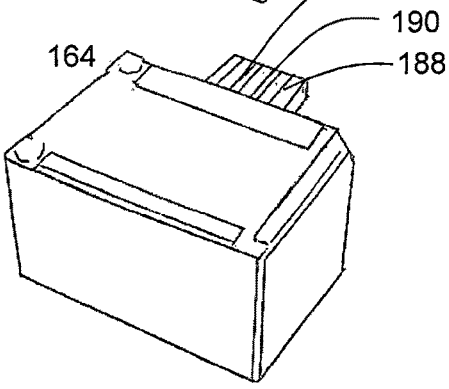
FIG. 5B depicts a perspective view of a safety and arming device according to one or more embodiments of the disclosure.
Figure 5C:
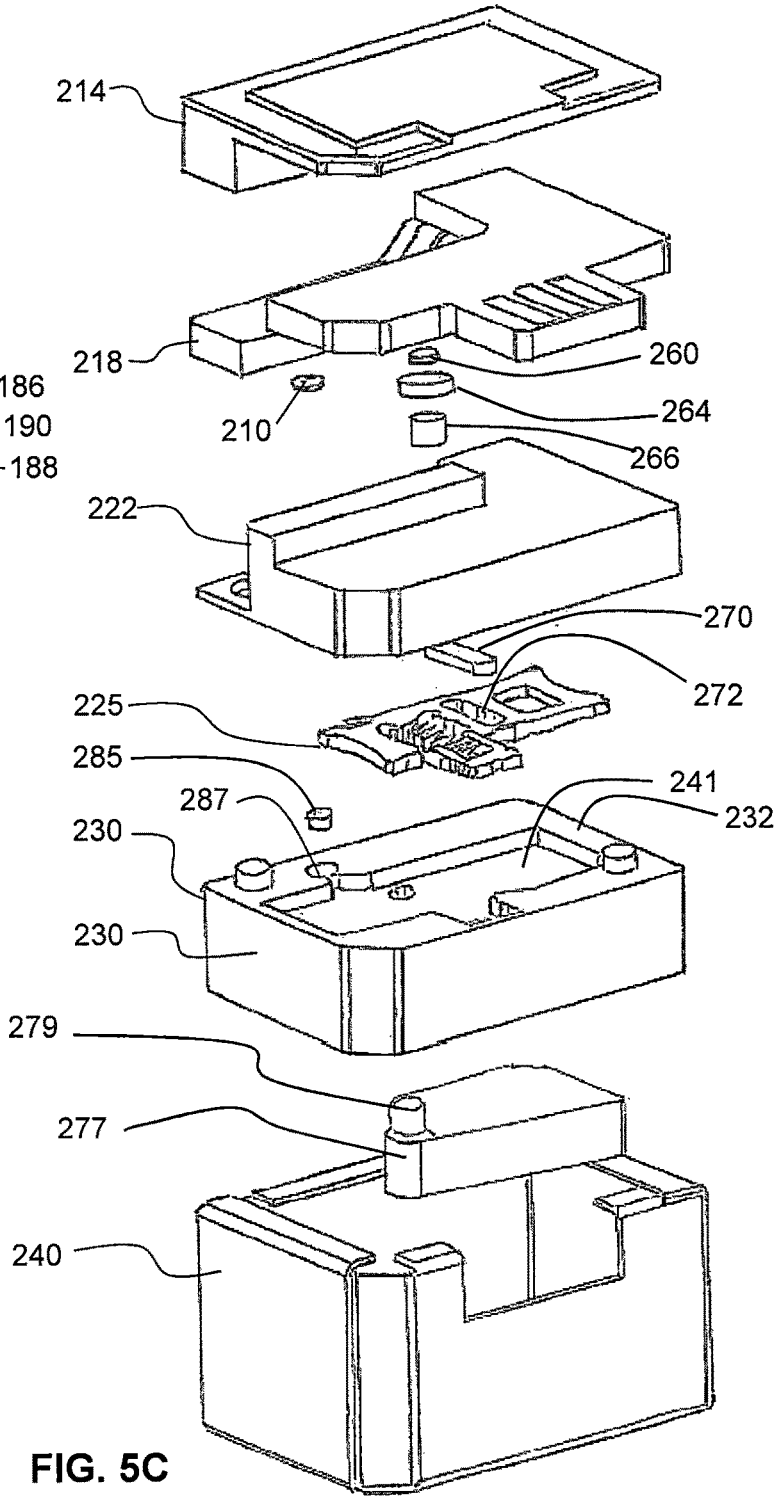
FIG. 5C is an exploded view of the safety and arming device of FIG. 5B.

Referring to FIGS. 5A-5C, the MEMSAD 200 is illustrated in perspective view and an exploded view. In embodiments, the MEMSAD 200 may be constructed in layers as illustrated with a metal container 210 enclosing the layers. Referring to the exploded view, the internal components comprise a container lid 214, an initiator board 218, a sliding arming mechanism cover 222, an arming slider 225, an sliding arming mechanism frame and base 230, that includes a frame portion 232 and a base portion 234, and a lower metal container portion 240. The arming slider 225 seats in an arming slider recess 241 defined by the frame and base 230. The configuration of the arming slider 225 that cooperates with the frame and base 230 is tunable to accommodate different launch accelerations and spin rates of projectiles as more fully described below.

Referring to FIGS. 5C, 6A, 6B, and 6C, the energetics define a warhead detonation micro firetrain 250 and a command lock release firetrain 254. The warhead detonation firetrain energetics include a detonator spot charge 260 that is deposited in the initiator board and is ignited by a voltage across the detonation conductor 188 and the common conductor 190 provided by the TSAM, a first transfer charge 264 positioned directly below the detonator spot charge, a second transfer charge 266 positioned below the first transfer charge and may be in a conforming recess in the sliding arming mechanism cover 222. A further arming slider transfer charge 270 is in the elongate recess 272 in the arming slider 225. The base and frame contain the main detonation output charge 277 with a stem charge portion 279 extending toward armed slider recess 241. The main detonation output charge 277, when detonated, is of sufficient strength to breach the canister to provide ignition to the high explosive warhead of the projectile. In embodiments, the canister may have ports or weakened areas to facilitate the detonation fire train to the main warhead explosive.

Figure 6A:
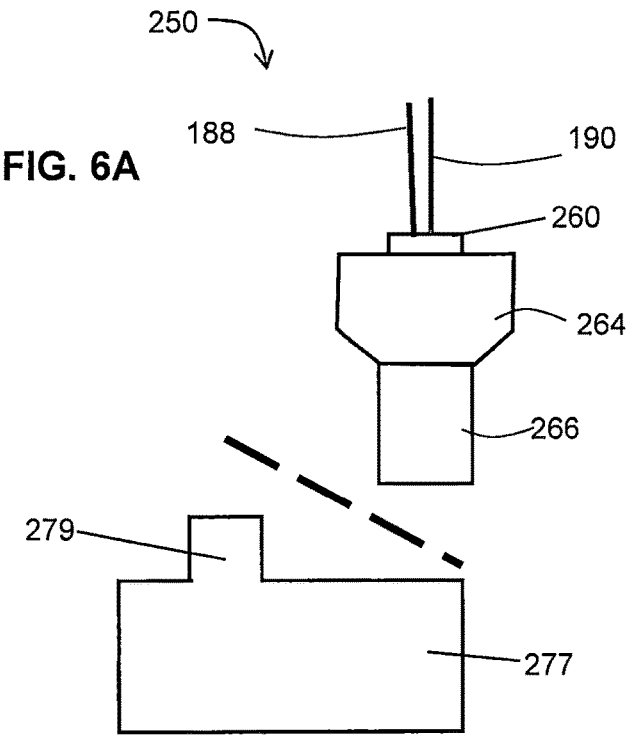
FIG. 6A is an elevational view of a micro firetrain for detonation of a warhead of a munition.
Figure 6B:
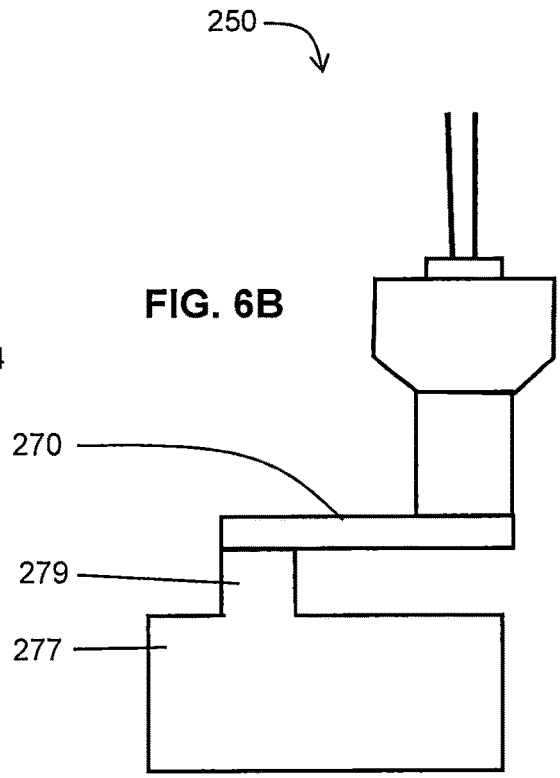
FIG. 6B is an elevational view of a micro firetrain for a command lock release.

As discussed in further detail below, the arming slider moves between a safe unarmed position, to an unarmed intermediate position, to an armed position. Only in the armed position is the arming slider transfer charge in alignment with the main detonation output charge as illustrated in FIG. 6B. FIG. 6A shows the detonation fire train interrupted as illustrated by the dashed line. The arming slider elongate recess 272 with the transfer charge 270 is not in alignment with the transfer charge 266 and the stem charge portion 279 when in the initial unarmed position or the intermediate position as depicted by FIG. 6A.

Figure 6C:
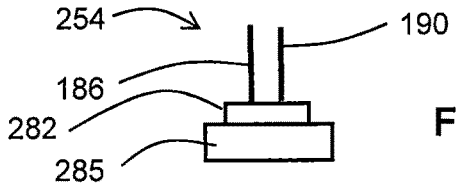
FIG. 6C is an elevational view of a micro firetrain for a command lock release and an arming slider push.

Referring to FIGS. 5C and 6C, the command lock release firetrain 254 may include the spot charge 282 at the initiator board initiated by a voltage across the command lock release conductor 186 and the common conductor 190. The lock release charge 285 is deposited in a recess 287 in the frame and base 230. This firetrain 254 is discussed further below with reference to FIGS. 11 to 16.

Figure 6D:
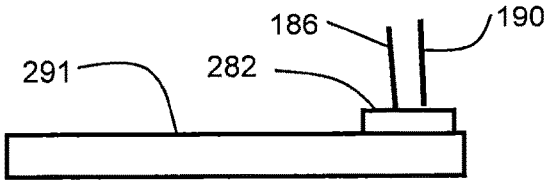
FIG. 6D is an elevational view of a micro firetrain for a command lock release and an arming slider push.

FIG. 6D is a command lock release and slider actuation firetrain 290 suitable for projectiles with low spin rates on no spinning and is discussed further below. The firetrain includes the spot charge 282 at the initiator board initiated by a voltage across the command lock release conductor 186 and the common conductor 190. The spot charge detonates the lock release and slider arm actuation charge 291. This firetrain 290 is discussed further below with reference to FIGS. 17 to 22.

Referring to FIGS. 7-10, the tunable setback arming mechanism or TSAM 300 comprises the arming slider 225 and the frame and base 230. The arming slider is generally formed of a homogeneous piece of metal, for example stainless steel, but may be formed of other electrically conductive materials. The arming slider has a main body 302 with a forward end 303, defined by the sliding direction of the slider, and a rearward end 305. An exteriorly facing edge wall surface 307 defines a peripheral footprint 309 of the arming slider 225.

Figure 7:
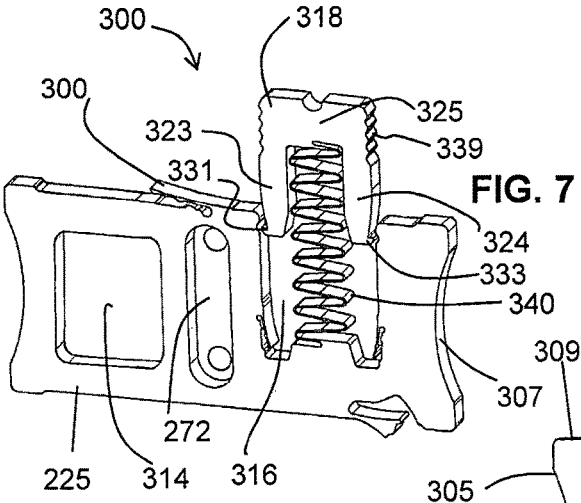
FIG. 7 is a perspective view of setback arming slider, according to one or more embodiments of the disclosure.
Figure 8:
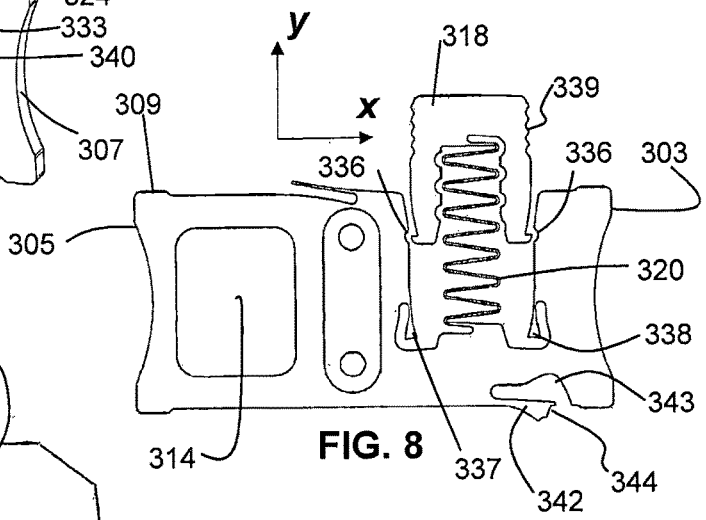
FIG. 8 is a front elevation view of the setback arming slider of FIG. 7.
Figure 9:
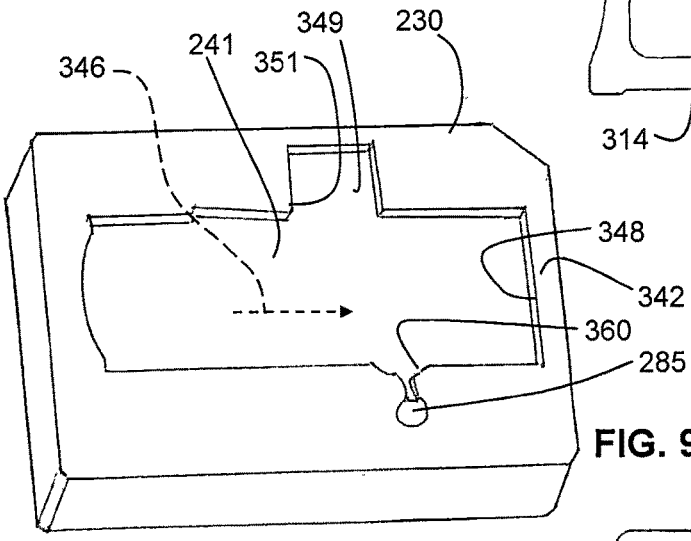
FIG. 9 is a perspective view of a setback arming slider frame for receiving the setback arming slider.
Figure 10:
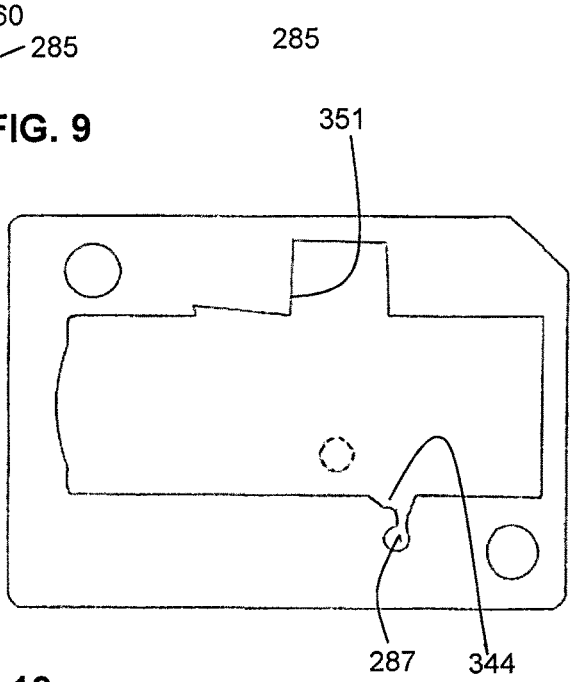
FIG. 10 is a plan view of the setback arming slider frame of FIG. 9 also depicting the location of an energetic charge recess.
Figure 14:
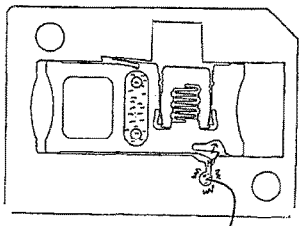
FIG. 14 is a plan view of the setback and arming mechanism of FIGS. 12-13 with the command latch release charge initiated for releasing the command latch.

The arming slider 225 has a mass reducing aperture 314 configured as a window with a generally rectangular shape positioned at the rearward end 305. This mass reduction window, in addition to reducing slider mass, reduces the surface area of the slider, which is believed to minimize out-of-tolerance issues and friction variables in the interfacing of the arming slider and frame and base. Toward the forward end 303 a setback slider slot 316 is defined and has a setback slider 318 projecting therefrom, the setback slider 318 connecting to and being unitary with the main body of the slider by of the setback spring 320. The setback slider having a generally U-shape with the spring 320 captured between the legs 323, 324 of the setback slider 318 and extending from the cross member 325. Each leg has an end 328, 329 with a laterally and outwardly projecting latch catches 331, 333 thereon. The latch catches are aligned with and corresponding to recesses 336 in the edge surface of the main slider body when the setback slider is in the projecting position as illustrated in FIGS. 7 and 8. When the setback slider is forced into the slot, the latch catches deflect the latch members 337, 338 and the setback slider is captured in the slot as the latch members spring back. The setback slider has serrations 339 at the upper leg portions and at the cross member 325. Centrally positioned on the upward edge as illustrated on FIGS. 7 and 8, a locking latch 340 is defined in the exterior periphery of the arming slider 225 and is configured as an outwardly and rearwardly extending tapering finger. Positioned intermediate the setback slider slot 317 and the mass reducing window is the elongate recess 272 for receiving the transfer charge 270. Positioned at the forward end of the main body on the side opposite the setback slider slot is the command latch 342 that projects forwardly and slightly downwardly. A command latch receiving recess 343 is provided to allow folding of the command latch inwardly. The command latch has a forward seating surface 344.

In embodiments, the slider has a uniform thickness throughout except at the elongate recess 272 for the transfer charge. In embodiments, the thickness can range from 0.30 mm to 1.00 mm. In embodiments, the thickness can be less than 1.50 mm. In embodiments, the thickness can be less than 2.00 mm. In embodiments, the recess for the transfer charge can have a unitary membrane for holding the transfer charge, in embodiments the membrane can be less than 0.01 mm thick. The setback slider may be machined as described in detail below.

The frame and base have a arming slider recess 241 that conforms to the peripheral footprint 305 of the arming slider and defines a length wise sliding pathway 346 in the elongate or the x direction as indicated by the coordinate axis of FIG. 8. The frame and base have an edge portion 348 with an inwardly facing edge wall surface 345. The base and frame further defining a setback slider recess 349 that receives the setback slider 318. A forward facing edge wall surface 351 defining the setback slider slot also acts as a catch surface for the locking latch 340 that is positioned on the arming slider such that when the arming slider moves to the armed position at the most forwardly arming slider position, the latch catches the wall surface 351 and secures the arming latch in the armed position, precluding rearward movement of the arming slider.

The base and frame further define a recess 357 for receiving the command latch 342. When the arming slider is in the safe mode fully rearward, the command latch 342 extending outwardly is accommodated by the recess 344. When the arming slider is urged forward, the forward facing surface 344 of the command latch 342 engages the stop surface 360 to stop the forward movement of the arming slider. The recess 357 is continuous with the command lock release charge recess 287. When the command latch engages the stop surface 360, detonating the command lock release charge 285 folds the command latch inwardly releasing the arming slider to slide to the full forward armed position.

The base and frame may be unitarily formed by machining from metal or by die casting, or by metal powder injection molding or by other means known in the art. In embodiments, a separate frame may be machined from a piece of sheet metal and a base portion be engaged therewith.

Figure 11A:
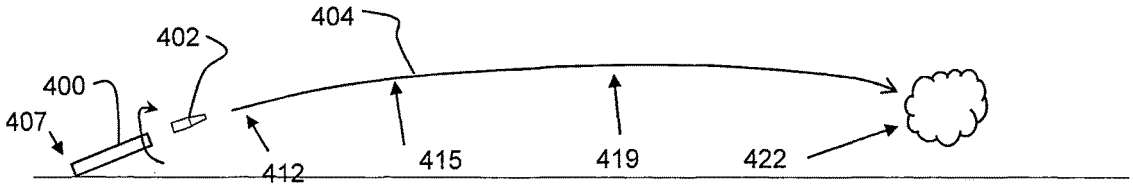
FIG. 11A is a pictorial view illustrating an exemplary firing path of a barrel spun projectile in accord with embodiments.
Figure 11B:
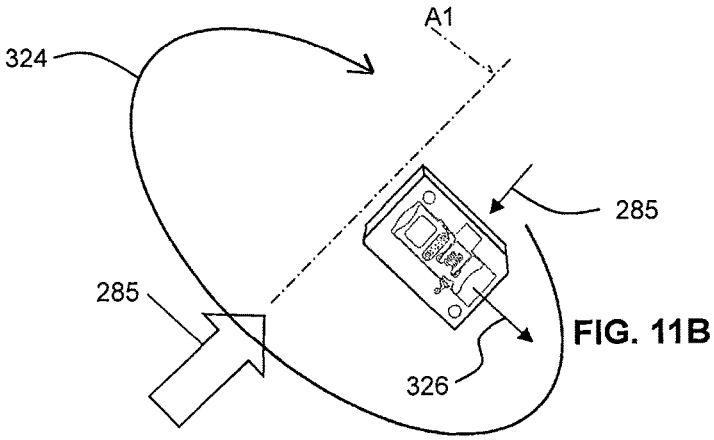
FIG. 11B is a pictorial view illustrating the forces acting on a setback arming mechanism upon firing.
Figure 23:
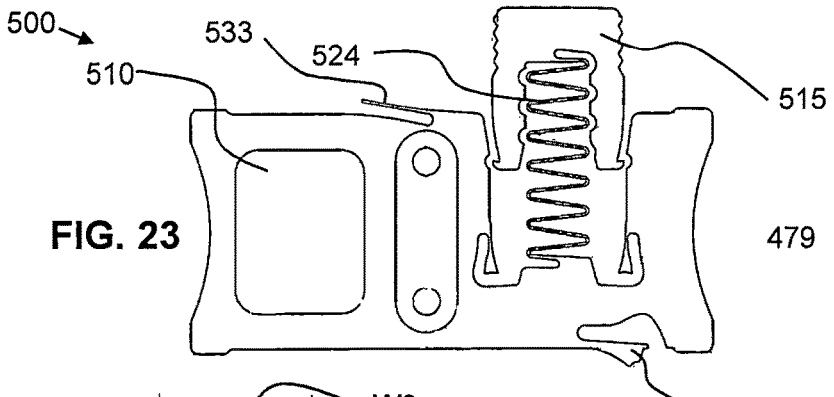
FIG. 23 is a plan view of an arming slider with a mass reducing arming slider aperture.
Figure 24:
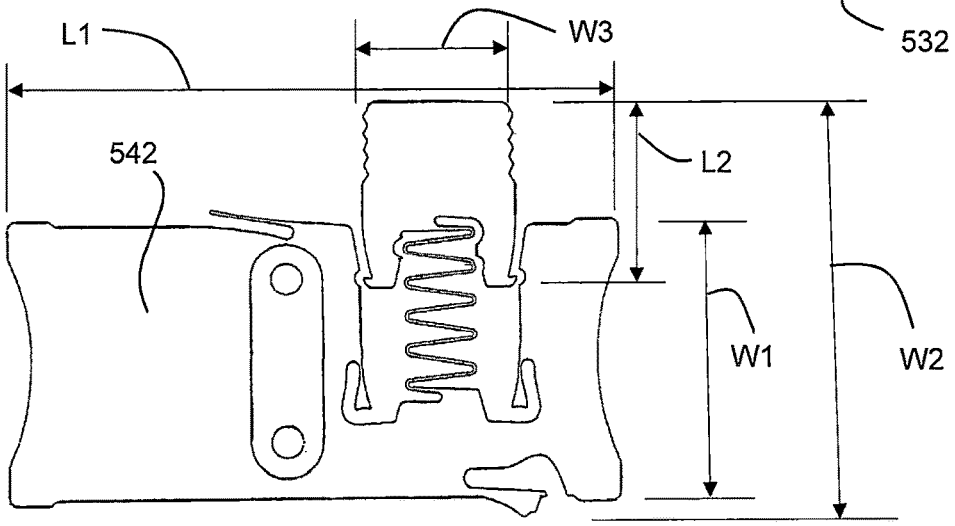
FIG. 24 is a plan view of an arming slider with the same peripheral footprint as the slider of FIG. 23, but with significantly different masses of the arming slider due to the lack of an aperture, and a setback slider with a greater mass due to the shorter legs.
Figures 26A, 26B:
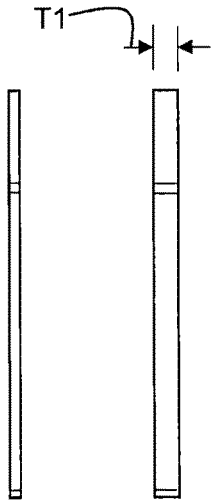
FIG. 26A is an end view of an arming slider illustrating a first thickness.
FIG. 26B is an end view of another arming slider illustrating a greater thickness compared to the arming slider of FIG. 26A providing a higher mass for the arming slider.

Referring to FIGS. 11A-16, the tunable setback arming mechanism 300, or TSAM, is illustrated in its different positions corresponding to specific stages of launching and projectile travel. FIG. 11A represents a rifled barrel 400 firing a projectile 402, such as an artillery shell, where the projectile circuitry has fuzing with MEMSAD with a TSAM 300 in accord with embodiments, the projectile following a flight path 404. Referring to FIG. 11B, a diagrammatic illustration of the pertinent forces on the TSAM 300 when fired are illustrated.

Figure 13:
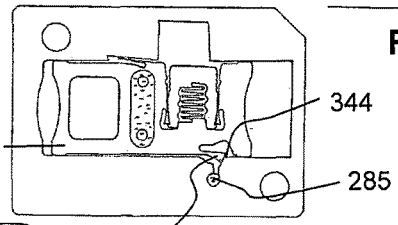
FIG. 13 is a plan view of the setback and arming mechanism of FIG. 12 after firing in a setback mode with the setback slider retracted into the setback slider slot and the arming slider advanced by centrifugal force from the spinning of the projectile, the arming slider stopped by a command latch.
Figure 12:
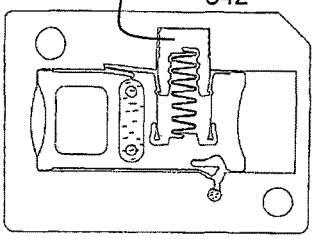
FIG. 12 is a plan view of a setback and arming mechanism in a pre-firing safe mode in accord with embodiments.

FIG. 12 represents the TSAM 300 in an unfired safe mode with the arming slider 225 in the safe, fully rearward position in the TSAM frame and body 230. The TSAM is positioned in the projectile with the setback slider 318 projecting out of the slot in the arming slider in the firing direction of the axis of the projectile. This is the prefiring state such as when the projectile is loaded in the barrel position 407. Upon firing, referring to FIGS. 11A and 12, the firing and attendant acceleration forces, indicated by the arrow 408, will impart the setback forces represented by the arrow 409 upon the setback slider 225. The setback forces overcome the setback slider spring 320 force, urging the setback slider into the setback slider slot capturing it therein as is illustrated in FIG. 13 corresponding to, for example, position 412 on the flight path. This may occur immediately upon firing while the projectile is accelerating in the barrel. The barrel imparts rotation, indicated by the arrow 324 in FIG. 11B, the projectile and thereby rotates the TSAM about the projectile axis A1 imparting centrifugal force, see arrow 326, on arming slider 225 which moves the slider from the rearward most position of FIG. 12 to an intermediate position of FIG. 13, for example at point 415 on the flight path, where the command latch 342 engages the stop surface 344 and stops the arming slider from further movement, until the command lock charge 285 is detonated by the fusing TSAM interface, see FIG. 14. This can occur based upon a time delay from firing, a signal from operators on the ground, or other triggering event. When the command lock charge 285 is detonated, the expanding gases force the command latch inwardly to unlock the arming slider, see FIGS. 14 and 15.

Figure 15:
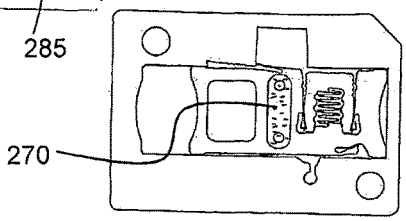
FIG. 15 is a plan view of the setback and arming mechanism of FIGS. 12-14 with the command latch released and the arming slider in a fully armed state with the arming latch lock engaged
Figure 16:
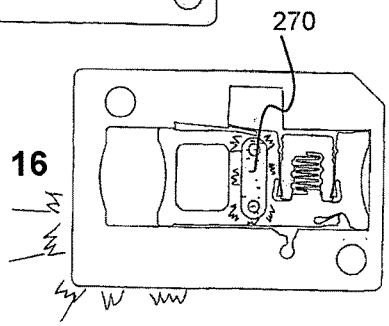
FIG. 16 is a plan view of the setback and arming mechanism of FIGS. 12-15 with the detonation micro fire train initiated.

Under the continuing centrifugal force provided by the spinning projectile the arming slider moves to the full forward position, the armed position, as illustrated in FIG. 15 and point 419 on the flight path. At this position, the transfer charge 270 is in alignment with the detonation spot charge, the first and second detonation transfer charges, and the main detonation output charge stem portion, see FIG. 6B and the associated text above. Upon the occurrence of a further trigger event, such as impact or proximity to a target or the ground, the fusing interface will initiate the detonation of the warhead detonation micro firetrain, including the transfer charge 270 and including the main detonation output charge with detonates the projectile warhead as illustrated in FIG. 16 and point 422 in the flight path of FIG. 11A.

Referring to FIGS. 17-22, a tunable setback arming mechanism 450, or TSAM, is illustrated in its different positions corresponding to specific stages of launching and projectile travel. FIG. 17 represents a non-rifled barrel 455 firing a projectile 452 that does not spin or spins at a very low rate. The projectile circuitry has fuzing with MEMSAD with a TSAM 450 in accord with embodiments, the projectile following a flight path 454.

This TSAM 450 cannot rely upon the high spinning rate of the projectile to provide centrifugal force to force the arming slider forwardly in the frame and base. The launching of the projectile still provides the high acceleration forces to impart the setback force on the setback slider as in TSAM of FIGS. 11A-16.

FIG. 18 represents the TSAM in the safe mode with the arming slider in the most rearward position, reflecting the projectile in a loaded non fired state in the barrel at point 460. Upon firing, the setback slider is forced rearwardly and latches into position as illustrated in FIG. 19 and point 462 on the flight path. A further setback member, such as ball 465, is positioned to impart a camming force on arming slider 470 at a forward cam surface 472. The setback member can be other shapes as well. As the setback force urges the ball downward, the arming slider is pushed forward to the intermediate position of FIG. 19 where the command latch 477 engages the stop surface 478 on the frame and base 480. As the projectile decelerates, such as due to wind resistance, or a downward tilt of the projectile, the setback member 465 may move forward which still precludes the arming slider from sliding rearward in the frame and base as depicted in FIG. 20 and the command latch 342 engaged with the stop surface 344 precludes the arming slider from moving forward to the armed position as in the previous embodiments, see point 480 on the flight path. In other embodiments, a latch may preclude the slider from moving backwards. In this embodiment, the frame and base 479 has an addition energetic pathway 481 from the command lock release charge to the rearward end of the arming slider recess 241 To move the arming slider from the intermediate position of FIG. 20 to the armed position, the command lock release charge is fired which, as in the previous embodiments, moves the command latch to an inward non-obstructing position, and also detonates the additional energetic pathway 481 which provides expanding gas pressure rearward of the arming slider thereby pushing the arming slider 470 forward with the command latch disengaged, see FIGS. 21 and 22A and point 483 on the flight path. The arming slider is fully forward and the TSAM is armed. Upon the occurrence of a further trigger event, such as impact or proximity to a target or the ground, the fusing interface will initiate the detonation of the warhead detonation micro firetrain, including the transfer charge 270 and including the main detonation output charge which detonates the projectile warhead as illustrated in FIG. 22B and point 483 in the flight path of FIG. 17.

Figure 25:
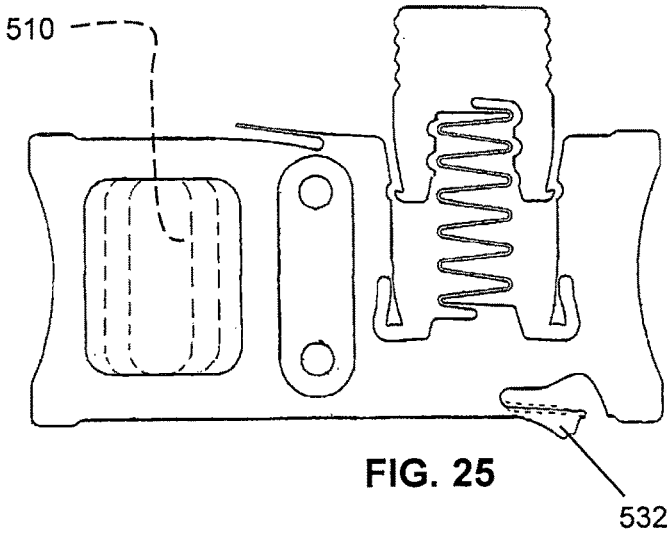
FIG. 25 is a plan view of another arming slider illustrating options for the mass adjusting aperture in the arming slider and different arm thicknesses of the command latch.

Referring to FIGS. 23 to 27C, an arming slider 500 of the tunable setback arming mechanism 504 is illustrated with variable configurations that allow the tuning of the TSAM for varying applications. The "tuning" is readily accomplished by simply resizing certain portions of the arming slider 500 during machining, which as discussed below is readily accomplished through manufacturing methods disclosed below. Specifically, the mass adjusting window 510 may be sized as indicated in FIG. 25, to significantly alter the mass of the arming slider 515. In embodiments, the window 510 may be eliminated. Similarly, the size of the setback slider 520, and accordingly the mass of the setback slider may be readily changed as illustrated by the different setback sliders in FIGS. 23, 24, and 25. Additionally, the spring force of the setback slider spring 524 provided to resist the retraction of the setback slider may be adjusted by altering the thickness of the spring strand 527, the length of the spring strand, the number of lobes 528, for example. Additionally, the command latch 532 thickness can be adjusted as indicated by the dashed lines of FIG. 25. A further adjustment for tuning, highly suitable for the manufacturing techniques described below, is the thickness of the arming sliders may be easily adjusted during manufacture, see FIGS. 26A and 26B, thereby significantly changing the mass of the arming slider and the setback slider, as well as increasing the spring force of the setback slider spring, other parameters of the spring remaining constant. Additionally, as described below, heat treating may be utilized to provide arming sliders of varying characteristics by changing the ductility, tensile strength, and hardness of the homogeneous metal forming the setback slider. In embodiments, the tuning of characteristics may also be provided by changing the metal or metal formulation being utilized for the TSAM components. The slider body 542 may have a length L1, in embodiments of less than 1.0 cm. In embodiments, the length L1 may be less than 1.5 cm. In embodiments, the length L1 may be less than 0.75 cm. In embodiments, the length L1 may be in a range of from 0.5 cm to 1.0 cm. The slider body 542 may have width W1, not including the command latch 532, the setback slider 515, and the locking latch 533 of less than 0.5 cm. In embodiments, the width W1 may be less than 0.8 cm. In embodiments, the width W1 may be less than 0.4 cm. In embodiments the width W1 is less than 50% of the length L1. In embodiments, the width W1 is in the range of 0.25 cm to 1.0 cm. In embodiments, the width W2 of the arming slider including the setback slider 515 is less than 0.7 cm. In embodiments, the width W2 is less than 1.0 cm. In embodiments the width W2 may be less than 0.5 cm. In embodiments, the thickness T1 of the arming slider 500, which reflects the original thickness of the work piece, may be less than 0.5 mm. In embodiments, the thickness T1 is less than 0.8 mm. In embodiments, the thickness T1 is less than 0.4 mm. In embodiments, the thickness T1 is in the range of 0.2 mm to 1.6 mm. In embodiments, the length L2 of the setback slider 515 is less than 0.2 cm. In embodiments, the length L2 is less than 0.4 cm. In embodiments, the length L2 is in the range of from 0.3 cm to 0.6 cm. In embodiments, the width W3 of the setback slider is less than 0.2 cm. In embodiments, the width W3 is less than 0.4 cm. In embodiments, the width W3 is in the range of from 0.15 cm to 0.5 cm. In embodiments, the thickness of the setback slider is the same as the thickness T1 of the arming slider body 542.

Although the setback slider 515 is shown positioned by way of the zig zag spring 524, a simple single leaf spring or two or more leaf springs could also hold it in position. With two or more leaf springs a four bar linkage is defined that can guide the movement of the setback slider.

Figure 27A:
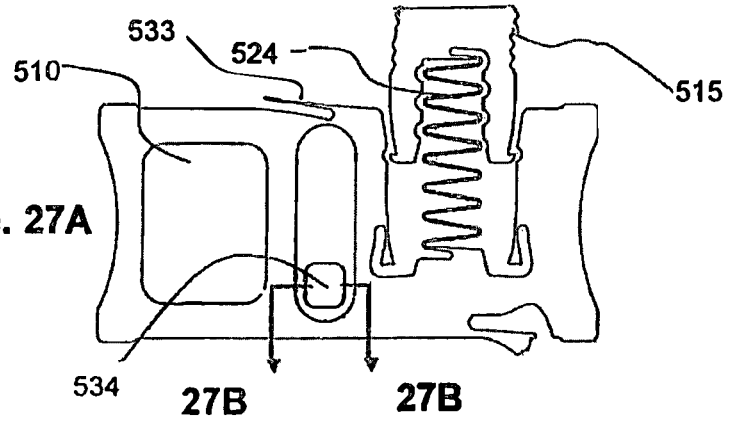
FIG. 27A is a plan view of another arming slider illustrating options for a flyer in the recess.
Figure 27B:
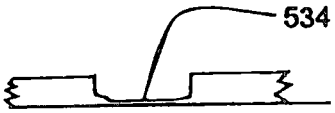
FIG. 27B is a cross sectional view of the arming slider of FIG. 27A taken at line 27B-27B.
Figure 27C:
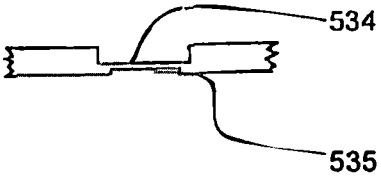
FIG. 27C is a cross sectional view of the arming slider of FIG. 27B with the flyer traversing a barrel.

FIGS. 27A, 27B, and 27C illustrate another arming slider with a flyer 534, a thinned region, machined into the arming slider at the recess 270. The flyer may be 4-50 microns thick in embodiments. Upon detonation, the flyer launches and traverses a barrel 535, a gap between the flyer and the charge 4 and impacts at detonation speed into the detonation output charge 277.

Figure 28A:
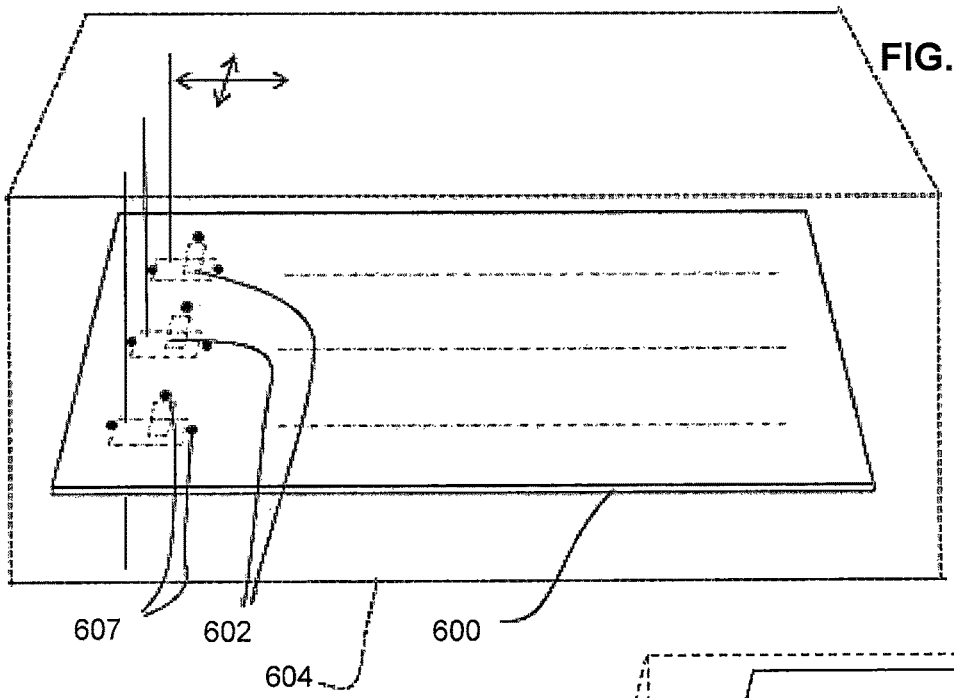
FIG. 28A is an illustration of thin wire electronic discharge machining of a plurality of arming sliders on a piece of sheet metal.
Figure 28B:
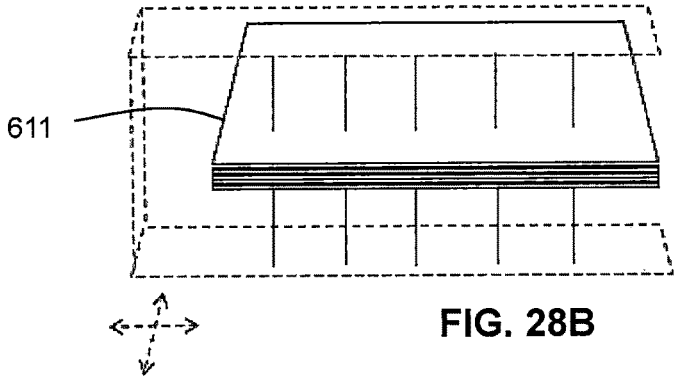
FIG. 28B is an illustration of thin wire electronic discharge machining of a plurality of stacked work pieces for simultaneously machining a multiplicity of work pieces.

Referring to FIGS. 28A, 33, 34, and 35, a piece of sheet metal, a work piece 600 sized for being machined to form a plurality of or multiplicity of arming preforms 602 is positioned in a thin or micro wire electronic discharge machine 604, illustrated diagrammatically. The dashed lines of FIG. 28A indicating the preforms extend across the work piece. Starter holes 607 for initial insertion of the EDM are provided in the work piece by conventional means. In embodiments each preform may have two or more starter holes for insertion of an EDM wire. Each of the preforms on a work piece 600 may be formed simultaneously with an EDM wire at a corresponding starter hole on each preform. In embodiments, sets of the preforms on a particular work piece may be machined simultaneously. This allows each set to have different patterns resulting in different operating characteristics of each set. Each set having an identical cut pattern. Depending on the setup of the EDM machine either the work piece or the fixture holding the EDM wires will move following a pattern received by the EDM machine. A cut pattern 609 by the EDM wires is illustrated by the two preforms 602 of FIG. 35. In another embodiment, a stack 611 of work pieces may be simultaneously machined by EDM as diagrammatically illustrated in FIG. 28B.

The use of two or more holes allow the EDM pattern to include micro tabs 611 to secure the preform in place facilitating additional operations and addition of energetics as described below. Each preform in FIG. 34 has four starter holes 607 allowing for three support micro tags to secure the preform in the work piece and a mass control window 510. Each starter hole associated with a portion of the entire EDM cut pattern portion. See, in particular, FIG. 37.

Although EDM machining has conventionally been considered to be a very slow machining process, utilizing multiple wires to simultaneously cut multiple preforms on a single or stacked work pieces, in association with the overall short lengths of the cuts, overcomes these perceived disadvantages in this application. EDM machining a multiplicity of preforms and then removing the preforms as arming sliders is an exceptionally expedient process.

Figure 29:
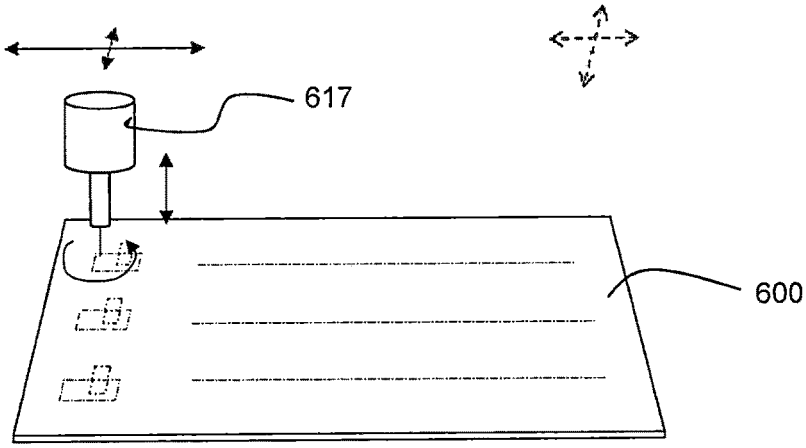
FIG. 29 is a detailed view of a preform arming sliders retained in a piece of sheet metal such as that shown in FIG. 28 with a further machining operation such as by milling.
Figure 36:
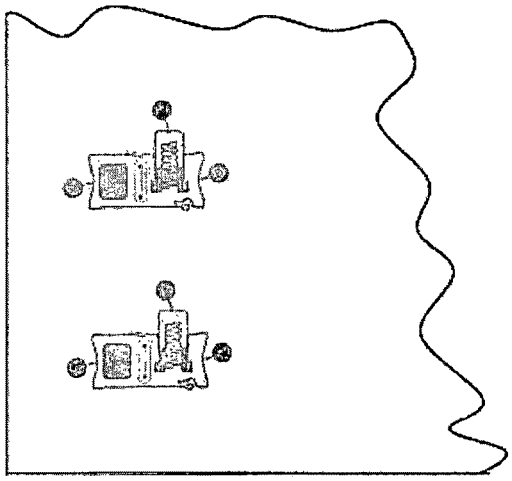
FIG. 36 is a plan view of the work piece of FIG. 35 after further machining for forming the transfer charge recess.
Figure 37:
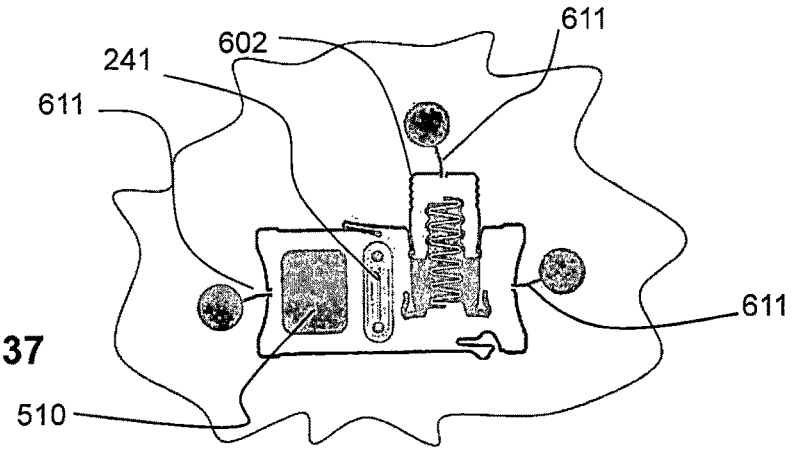
FIG. 37 is a detail view of the machined preform of FIG. 36 with tabs securing the preform in position on the work piece.

Referring to FIGS. 29, 36, and 37, a further machining operation to be performed on each preform utilizes a milling machine 617 for removing material in each preform to form the transfer charge recess 241. The machining may leave a metal membrane with a pair of apertures, the metal membrane may be, in embodiments, in the range of 4 to 50 microns, for example. The milling machine may also provide thinning of specific portions of the preform to adjust select functionalities beyond that provided by the pattern shape. For example, a recess may be machined in the setback slider rather than a through window, thinning a region near the rearward end to reduce mass of the final arming slider. The machining allows each preform of a set of preforms to have a range of different masses, allowing efficient testing of samples for optimal performance in specific projectile environments. For example, a plurality of TSAMs may be test fired in a projectile to identify the optimal performing arming slider of the plurality of TSAMs where the arming sliders have varying masses.

Figure 30:
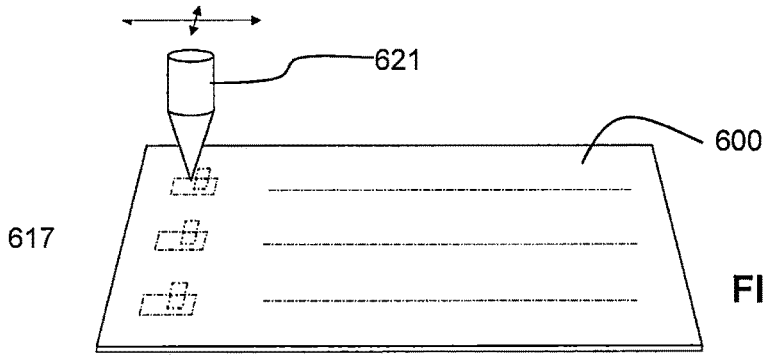
FIG. 30 is a pictorial perspective view illustrating adding energetic charges to preform arming sliders by an automated paste injection equipment.
Figure 31:
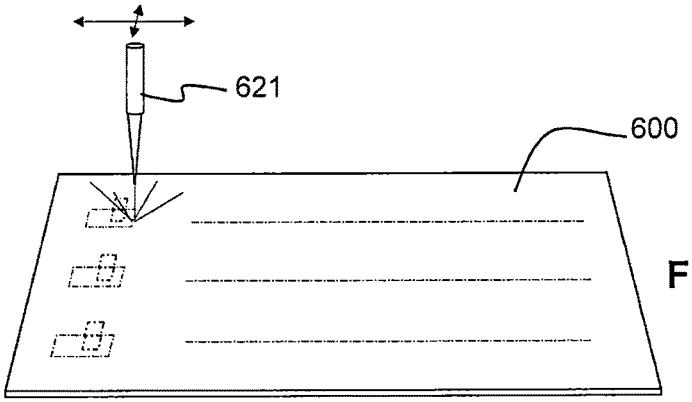
FIG. 31 is a view of the piece of sheet metal of FIGS. 28-30 with arming slider preforms being separated from the piece of sheet metal by a machining process, for example, a laser cutter.

Referring to FIGS. 30, 31, and 37, a dispenser may deposit energetic material in the transfer charge recesses of each preform. After curing of the energetic material, the tabs 611 holding the preforms in the work piece 600 may be cut by machining, such as by laser cutting by a laser 621 to release the arming sliders. The laser 621 may also be utilized to heat and/or anneal particular portions of a preform to provide desirable metal characteristics for example increasing the ductility of a command latch to provide deformation rather than resiliency so that the arm is retained in the command latch recess after detonation of the command latch energetic charge. The individual heat treating of specific preforms allow a set of final arming sliders to have a range of different metal characteristics of a specific structure of the arming sliders. This allows efficient testing of samples for optimal performance in specific projectile environments. For example, a plurality of TSAMs may be test fired in a projectile to identify the optimal performing arming slider of the plurality of TSAMs where each arming slider has a different metal characteristic for a structural feature of the arming sliders.

Figure 32:
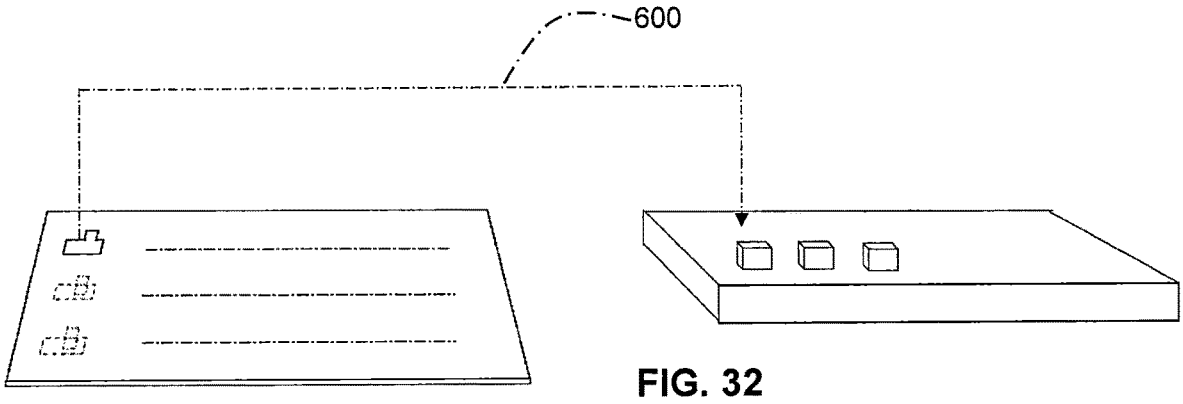
FIG. 32 is a pictorial view of a pick and place assembly of safety and arming fuze assemblies in accord with embodiments.
Figure 33:
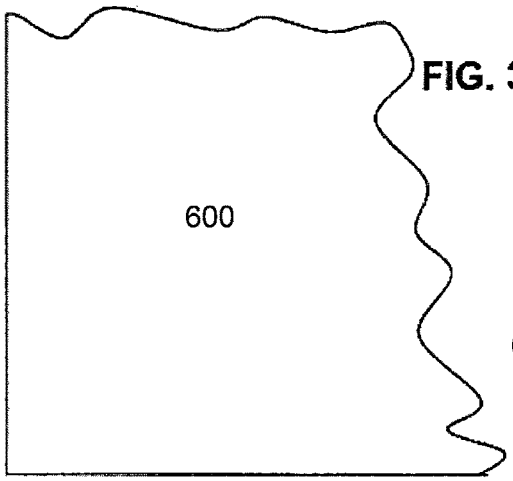
FIG. 33 is a plan view of a blank work piece for machining TSAM components.
Figure 34:
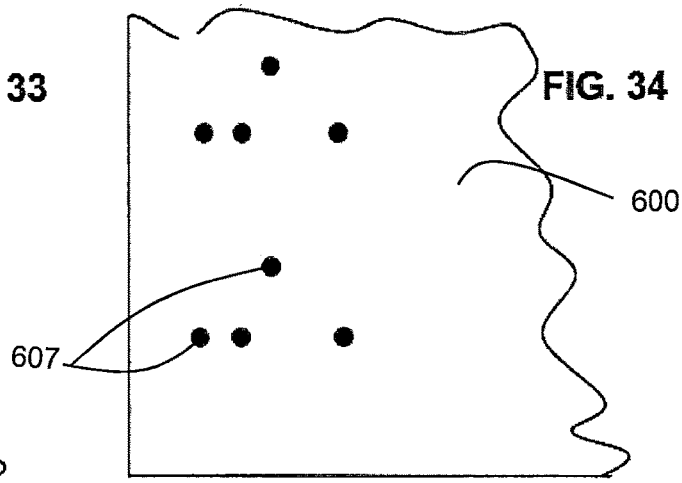
FIG. 34 is a plan view of the work piece of FIG. 33 with hole machined therein for micro wire EDM.
Figure 35:
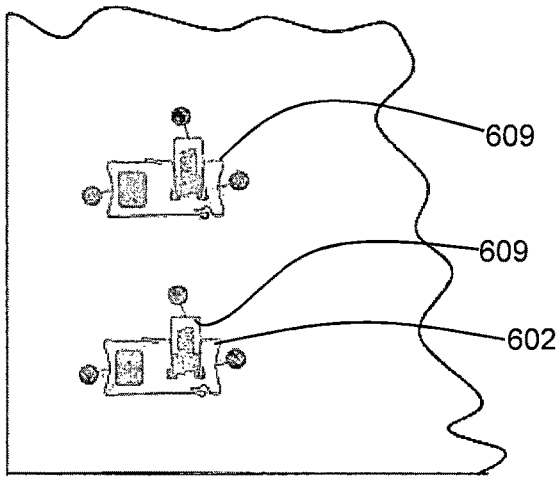
FIG. 35 is a plan view of the work piece of FIG. 34 after micro wire EDM providing a arming slider preform.

Referring to FIG. 32, the arming sliders and other components of the MEMSADs may be assembled by pick and place equipment 632 represented diagrammatically.

Figure 38:
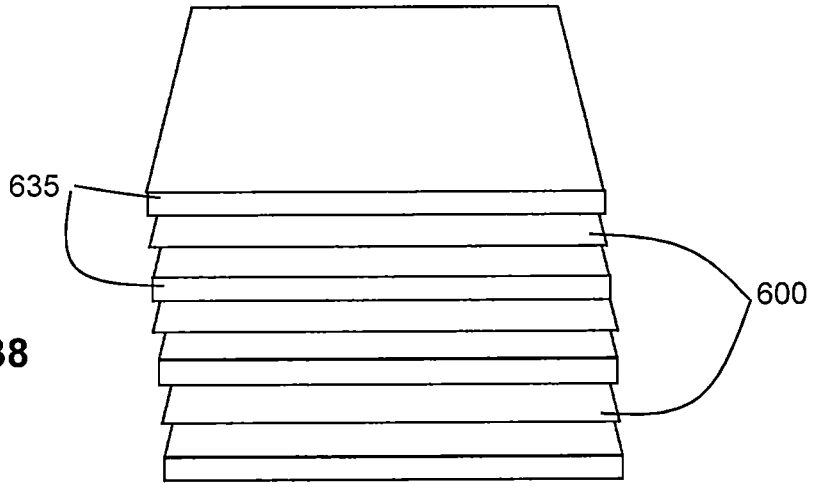
FIG. 38 is a perspective view of a spaced stack of work pieces and ceramic blocks for heat treating the work pieces.
Figure 39:
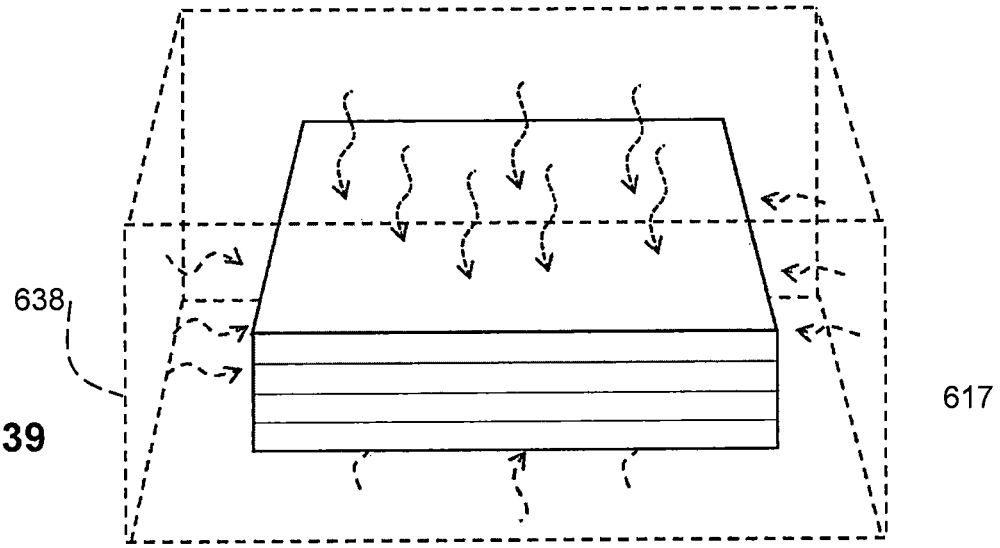
FIG. 39 is a perspective diagrammatic view of heat treating a plurality of work pieces of sheet metal for arming slider preforms.

Referring to FIGS. 38 and 39, the work pieces 600, either before the preforms are machined therein, or after machining, or during an intermediate step, may be heat treated to adjust select desirable metal characteristics. Suitably, work pieces 600 are stacked between blocks 635 of, for example, ceramic material, prior to placement in the heat treating unit 638.

Referring to FIG. 40, a table is provided setting forth steps in manufacture described above. The steps may be in different order and particular process may use select ones of the steps and, of course, additional steps. FIG. 41 provides a table of suitable design steps in tuning TSAM components for MEMSADs. FIG. 42 provides TSAM component variables that may be selected and adjusted for tuning setback arming sliders or other MEMSAD components.

In various embodiments, the projectiles may be a large/high caliber spin-stabilized projectile for firing from a rifled barrel or gun. For example, in certain embodiments, projectile 300 is a 155 mm projectile, 105 mm projectile, Navy 5' projectile, or other large caliber shell. The term "large caliber", "high caliber" or the like, as used herein, refers to projectiles having a caliber greater than or equal to 75 mm. However, in certain embodiments the projectile 300 can be a medium or small caliber projectile. As used herein, the term "small caliber" refers to projectiles of 50 caliber or less and the term "medium caliber" refers to projectiles greater than 50 caliber to 75 mm. In addition, the term "spin-stabilized", as used herein, means that the projectile is stabilized by being spun around its longitudinal (forward to rearward) central axis. The spinning mass creates gyroscopic forces that keep the projectile resistant to destabilizing torque in-flight. In addition, as used herein, the term "spin-stabilized" means that the projectile has a gyroscopic stability factor of 1.0 or higher. As such, while some projectiles, such as fin-stabilized projectiles, may have some amount of spin imparted on them during flight, the term "spin-stabilized" applies only to projectiles having a spin-rate such that the quantified gyroscopic stability factor achieves a value of 1.0 or higher.

Figure 43:
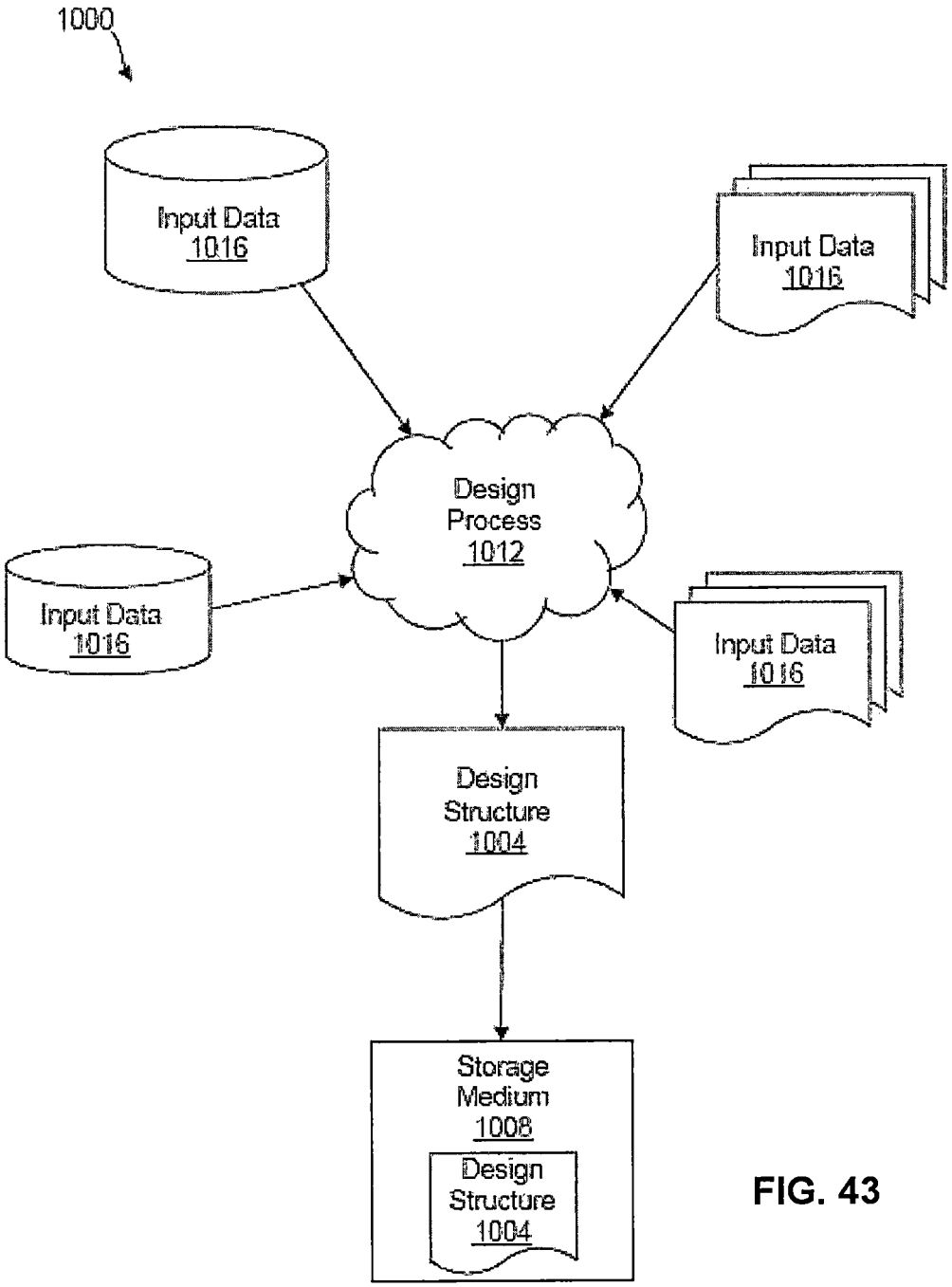
FIG. 43 depicts a flow diagram of a design process used in slider arming mechanism design and modeling, according to one or more embodiments.

FIG. 43 shows a block diagram of a design flow 1000 for generating a design structure 1004 encoded on a computer readable storage medium 1008 used for, in some embodiments, component modeling, simulation, and testing. Design flow 1000 includes processes, machines and/or mechanisms for generating design structures comprising logically or otherwise functionally equivalent encoded representations of the systems and/or devices described herein. For example, design structures may include data and/or instructions that when executed or otherwise processed on a data processing system generate a structurally, mechanically, aerodynamically, or otherwise equivalent representation of the components, structures, mechanisms, and elements as described herein. The design structures processed and/or generated by design flow 1000 may be encoded or stored on any suitable computer readable storage media 1008.

Processes, machines and/or mechanisms for generating design structures may include, but are not limited to, any machine used in circuitry design process, such as designing, manufacturing, modeling, or simulating component structure, circuitry and/or antenna performance. For example, machines may include, computers or equipment used in circuitry design, device modeling, or any machines for programming functionally equivalent representations of the design structures into any medium.

FIG. 43 illustrates a design structure 1004 that may be outputted by a design process 1012. Design structure 1004 may be a simulation to produce a structurally, electrically, and/or logically equivalent functional representation of setback arming mechanisms. In one or more embodiments, whether representing functional, structural, and/or electrical design features, design structure 1004 may be generated using electronic computer-aided design tools. Inventions herein include modeled or simulated devices.

As such, design structure 1004 may comprise files or other data structures including human and/or machine-readable source code, compiled structures, and computer executable code structures that when processed by a design processing system, functionally simulate or otherwise represent circuits, structure, or other levels of hardware logic design.

Design process 1012 may include processing a variety of input data 1016 for generating design structure 1004. Such data may include a set of commonly used components, and devices, including models, layouts, and performance characteristics, such as aerodynamic performance, for a given device. The input data may further include design specifications, design rules, and test data files which may include test results, and other testing information regarding components, devices, and circuits that are utilized in one or more of the embodiments of the disclosure. Once generated, design structure 1004 may be encoded on a computer readable storage medium or memory, as described herein.

One or more embodiments may be a computer program product. The computer program product may include a computer readable storage medium (or media) including computer readable program instructions for causing a processor to enhance target intercept according to one or more embodiments described herein.

The computer readable storage medium is a tangible, non-transitory, device that can retain and store instructions for use by an instruction execution device. The computer readable storage medium may be, for example, an electronic storage device, a magnetic storage device, an optical storage device, or other suitable storage media.

A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Program instructions, as described herein, can be downloaded to respective computing/processing devices from a computer readable storage medium or to an external computer or external storage device via a network, for example, the Internet, a local area network, a wide area network and/or a wireless network. A network adapter card or network interface in each computing/processing device may receive computer readable program instructions from the network and forward the computer readable program instructions for storage in a computer readable storage medium within the respective computing/processing device.

Computer readable program instructions for carrying out one or more embodiments, as described herein, may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The computer readable program instructions may execute entirely on a single computer, or partly on the single computer and partly on a remote computer. In some embodiments, the computer readable program instructions may execute entirely on the remote computer. In the latter scenario, the remote computer may be connected to the single computer through any type of network, including a local area network (LAN) or a wide area network (WAN), or public network.

One or more embodiments are described herein with reference to a flowchart illustration and/or block diagrams of methods, systems, and computer program products for impact fuzing according to one or more of the embodiments described herein. It will be understood that each block of the flowchart illustrations and/or block diagrams, and combinations of blocks in the flowchart illustrations and/or block diagrams, may be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some embodiments, the functions noted in the block may occur out of the order noted in the figures. For example, two blocks shown in succession may, in fact, be executed substantially concurrently, or the blocks may sometimes be executed in the reverse order, depending upon the functionality involved.

In addition to the above disclosure, the disclosure of the following U.S. Patents and Publications and PCT publications providing munitions suitable for incorporating the embodiments herein and related systems, including fusing systems, are fully incorporated by reference herein for all purposes. U.S. Pat. Nos. 6,422,507; 7,412,930; 7,431,237; 6,345,785; 6,981,672; 8,916,810; 6,653,972; 7,631,833; 7,921,775; 7,947,936; 8,063,347; 9,709,372; 9,683,814; 8,552,349; 8,757,064; 8,508,404; 7,849,797; 7,548,202; 7,098,841; 6,834,591; 6,389,974; 6,204,8015,734,389; 5,696,347; 9,709,372; 9,683,814; 9,031,725; 8,552,349; 8,757,064; 8,508,404; 7,849,797; 7,548,202; 7,098,841; 6,834,591; 6,389,974; 6,204,801; 5,734,389; 5,696,347; 6,502,786; 6,666,402; 6,693,592; 7,681,504; 8,319,163; 8,324,542; 8,674,277; 8,887,640; 8,950,335; 9,303,964; 9,360,286; 9,557,405; 9,587,923; 10,054,404; 2006/0061949; 2018/0245895; 2019/0041527; and WO2011/114089.

Patents and patent publications illustrating EDM equipment, techniques, and methods are provided in the following U.S. patents and U.S. patent publications which are incorporated herein for all purposes.

U.S. Pat. Nos. 4,475,996; 5,882,490; 5,4987,848; 7,950,149; 9,089,916; 10,086,457; 10,118,239; 10,300,542; 10,471,528; 2008/0257867; 2010/0140226; 2011/0114602; 2013/0228553; 2013/0240486; 2015/0144599; 2017/0266744.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A method of manufacturing a safe and arming fusing assembly, the method comprising:

a) machining using thin wire electronic discharge machine to simultaneously machine a plurality of arming slider preforms in a piece of sheet metal, each arming slider preform having a length dimension of less than a centimeter, having a width dimension of less than a centimeter, having a thickness dimension of less than 2 millimeters, the electronic discharge machining includes machining substantially JI of a periphery of a main body portion of each arming slider except for one or more peripheral bridging tabs for holding each arming slider in the piece of sheet metal, includes machining a setback slider slot in the main arming portion, includes machining a setback slider projecting out of the setback slider slot, includes machining a spring extending from the main arming portion to the setback slider, and further includes machining one or more latching projections extending from the periphery of the main body portion outwardly, thereby providing a plurality of arming slider preforms secured together in the piece of sheet metal, each arming slider preform secured within the piece of sheet metal by one or more peripheral bridging tabs;

b) heat treating the piece of sheet metal;

c) machining a micro firetrain charge recess in each of the main body portions of each of the plurality of slider preforms;

d) depositing an energetics charge into the charge recess of the main body of each of the arming slider preforms;

e) cutting each of the one or more peripheral bridging tabs securing each arming slider preform of the plurality of arming slider preforms in the piece of sheet metal thereby separating the respective arming slider preforms from the piece of sheet metal thereby providing a plurality of arming sliders;

f) placing each of the plurality of arming sliders into respective ones of a plurality of arming slider frames, each arming slider frames defining a recess for receiving the respective arming slider preform and providing three positions for each arming slider in the respective slider frame, a first unarmed position, a second intermediate position, and a third armed position, whereby each of the discrete arming sliders placed in respective ones of the plurality of slider frames defining a plurality of setback arming mechanisms;

g) assembling each of the setback arming mechanisms into a respective one of a fuzing assembly by placing an initiator portion at one face side of the setback arming mechanism and a warhead detonation portion at an opposite face side of the setback arming mechanism.

2. The method of claim 1, further comprising machining in each setback slider slot one or two latches extending from the main body portion into the setback slider slot for locking the setback slider in the setback slider slot in each arming slider preform.

3. The method of claim 1, wherein the placing of each arming slider into the respective arming slider frame further comprises using picking and placing equipment.

4. The method of claim 1, wherein the depositing of the flowable energetics in the charge recess of the main body recess of each of the plurality of preforms comprises an automated injector.

5. The method of claim 1, wherein the cutting each of the one or more peripheral bridging tabs of each of the plurality of arming slider preforms comprises laser ablation.

6. The method of claim 5, wherein the laser ablation is performed after the depositing the flowable energetics charge into the charge recess of the main body of each of the arming slider preforms.

7. The method of claim 1, wherein the heating the piece of sheet metal occurs after machining the plurality of arming slider preforms in the piece of sheet metal.

8. The method of claim 1, further comprising heating a plurality of such pieces of sheet metal with arming slider preforms therein and arranging the plurality of such pieces in a stack with ceramic material layers interlaced between adjacent pieces of sheet metal in the stack, and putting compressive force on the pieces of sheet metal in the stack during the heating.

9. The method of claim 1, wherein the placing the initiator portion at one face side of the setback arming mechanism further comprises selecting an initiator portion that has a first command energetic charge and a second micro firetrain detonation initiation energetic charge.

10. The method of claim 9, further comprising positioning the first command energetic charge in the initiator portion such that upon assembly the first command energetic charge is positioned at one of the one or more latching projections extending from the periphery of the main body when the arming slider is in the intermediate position.

11. The method of claim 9, further comprising positioning the second micro firetrain detonation initiation energetic charge in the initiator portion such that upon assembly the second micro firetrain detonation initiation energetic charge is aligned with the micro firetrain charge recess of the arming slider and the second micro firetrain detonation initiation energetic charge is aligned with a warhead detonation energetic charge in the warhead detonation portion when the arming slider is in the third armed positions.

* * * * *